US009434570B2

(12) United States Patent
Matsuo et al.

(10) Patent No.: US 9,434,570 B2
(45) Date of Patent: Sep. 6, 2016

(54) SHEET ALIGNMENT MECHANISM DETECTING STACK HEIGHT

(71) Applicant: KYOCERA DOCUMENT SOLUTIONS INC., Osaka (JP)

(72) Inventors: Takeshi Matsuo, Osaka (JP); Terumitsu Noso, Osaka (JP); Yasunori Ueno, Osaka (JP); Masahiko Miyazaki, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 50 days.

(21) Appl. No.: 14/284,578

(22) Filed: May 22, 2014

(65) Prior Publication Data

US 2014/0346726 A1 Nov. 27, 2014

(30) Foreign Application Priority Data

May 24, 2013 (JP) ..... 2013-109747
Jun. 28, 2013 (JP) ..... 2013-136052

(51) Int. Cl.

| | |
|---|---|
| ***B65H 37/04*** | (2006.01) |
| ***B65H 39/00*** | (2006.01) |
| ***B65H 31/34*** | (2006.01) |
| ***B65H 29/22*** | (2006.01) |
| ***B65H 31/04*** | (2006.01) |

(52) U.S. Cl.

CPC ..... *B65H 39/00* (2013.01); *B65H 29/22* (2013.01); *B65H 31/04* (2013.01); *B65H 31/34* (2013.01); *B65H 2301/16* (2013.01); *B65H 2511/152* (2013.01); *B65H 2511/16* (2013.01); *B65H 2511/20* (2013.01); *B65H 2553/412* (2013.01); *B65H 2553/612* (2013.01); *B65H 2701/1315* (2013.01); *B65H 2701/18292* (2013.01); *B65H 2801/27* (2013.01)

(58) Field of Classification Search

CPC ..... B65H 37/04; B65H 39/00; B65H 29/22; B65H 31/04; B65H 31/34
USPC ..... 270/58.08, 58.09, 58.11, 58.12, 58.13
See application file for complete search history.

(56) References Cited

U.S. PATENT DOCUMENTS

| | | | | |
|---|---|---|---|---|
| 5,609,333 A * | 3/1997 | Mandel | B65H 39/11 270/58.09 |
| 6,612,560 B2 * | 9/2003 | Sanders | B65H 31/00 270/58.08 |
| 6,832,759 B2 * | 12/2004 | Nagasako | B65H 31/10 271/220 |
| 7,325,800 B2 * | 2/2008 | Brown | B65H 43/06 270/52.06 |

(Continued)

FOREIGN PATENT DOCUMENTS

| | | |
|---|---|---|
| JP | H05-319679 A | 12/1993 |
| JP | 2002-356270 A | 12/2002 |

(Continued)

*Primary Examiner* — Patrick Mackey
(74) *Attorney, Agent, or Firm* — Studebaker & Brackett PC

(57) ABSTRACT

A sheet processing device includes an exit tray and a sheet alignment mechanism. On the exit tray, ejected sheets or ejected sheet sheaves subjected to stapling are stacked. When at least a sheet is ejected, the sheet alignment mechanism aligns the sheets in a manner to be in contact with and catch opposite ends of the sheets stacked on the exit tray from a base end side of the exit tray. When a sheet sheaf is ejected, the sheet alignment mechanism comes in contact with a plurality of points on a topmost surface of the sheet sheaves stacked on the exit tray to detect a height difference between the plurality of points.

13 Claims, 10 Drawing Sheets

(56) References Cited

U.S. PATENT DOCUMENTS

| | | | | |
|---|---|---|---|---|
| 7,448,615 | B2 * | 11/2008 | Takamura | B42C 1/12 270/58.11 |
| 8,070,150 | B2 * | 12/2011 | Tanaka | B65H 31/10 270/58.11 |
| 8,191,885 | B2 * | 6/2012 | Hattori | B65H 31/3081 270/37 |
| 8,657,283 | B2 | 2/2014 | Iwata et al. | |
| 2002/0113362 | A1 * | 8/2002 | Saito | B65H 37/04 271/207 |
| 2002/0158405 | A1 | 10/2002 | Nagasako et al. | |
| 2013/0026707 | A1 | 1/2013 | Iwata et al. | |

FOREIGN PATENT DOCUMENTS

| | | | |
|---|---|---|---|
| JP | 2006-273561 | A | 10/2006 |
| JP | 2006273561 | A * | 10/2006 |
| JP | 2009-107777 | A | 5/2009 |
| JP | 2013-049573 | A | 3/2013 |

* cited by examiner

SHEET ALIGNMENT MECHANISM DETECTING STACK HEIGHT

INCORPORATION BY REFERENCE

The present application claims priority under 35 U.S.C. §119 to Japanese Patent Application No. 2013-109747, filed May 24, 2013 and No. 2013-136052, filed Jun. 28, 2013. The contents of these applications are incorporated herein by reference in their entirety.

BACKGROUND

The present disclosure relates to sheet processing devices that perform preset processing on a sheet, such as stapling, and image forming apparatuses including such a device.

Image forming apparatuses of some type include a post sheet processing device. The post sheet processing device performs post processing, such as stapling, on a sheet on which an image is formed by an image forming apparatus main body, such as a copier, a multifunction peripheral, etc.

Some post sheet processing device includes an exit tray and a staple contact strip. To the exit tray, book-like bound sheets, that is, a plurality of sheets subjected to stapling are ejected. The staple contact strip is provided at a position corresponding to a staple part of sheets subjected to stapling and is capable of intercepting a light beam of a photointerrupter.

In view of the fact that where the book-like bound sheets are stapled at their one corner part, the staple part is higher than any other part and the inclination of the topmost surface of the book-like bound sheets becomes large, the post sheet processing device detects the upper limit of the book-like bound sheets stacked on the exit tray and moves the exit tray downward. In other words, when the staple contact strip comes in contact with and is pushed upward by the topmost surface of the book-like bound sheets ejected to the exit tray, the light beam of the photointerrupter is intercepted, so that the upper limit of the book-like bound sheets stacked on the exit tray is detected. Accordingly, the exit tray is lifted down so as to allow the next book-like bound sheets to be ejected.

SUMMARY

A sheet processing device according to the first mode of the present disclosure includes an exit tray and a sheet alignment mechanism. On the exit tray, ejected sheets or ejected sheet sheaves subjected to stapling are stacked. The sheet alignment mechanism is configured to align, when at least a sheet is ejected, the sheets in a manner to be in contact with and catch opposite edges of the sheets stacked on the exit tray from a base end side of the exit tray. When a sheet sheaf is ejected, the sheet alignment mechanism comes in contact with a plurality of points on a topmost surface of the sheet sheaves stacked on the exit tray to detect a height difference between the plurality of points.

A sheet processing device according to the second mode of the present disclosure includes an exit tray and a sheet alignment mechanism. On the exit tray, ejected sheets or ejected sheet sheaves subjected to stapling are stacked. The sheet alignment mechanism is configured to align at least the sheets stacked on the exit tray in a manner to move the sheets in a shifting direction orthogonal to an ejection direction in which a sheet is ejected and to a stacking direction in which a sheet is stacked. The sheet alignment mechanism includes a pair of alignment members and a pair of moving mechanisms. The pair of alignment members are capable of coming in contact with opposite end parts of at least the sheets in the shifting direction. The pair of moving mechanisms are configured to move the pair of alignment members in the shifting direction. When the stapling is performed on one end parts of sheet sheaves in the shifting direction, one of the pair of moving mechanisms moves an alignment member of the pair of alignment members, which is arranged correspondingly to the other end parts of the sheet sheaves in the shifting direction, to a receiving position. The receiving position is a position displaced in the shifting direction from a reference position to separate the alignment member from the sheet sheaves. The reference position is a position where the alignment member comes in contact with the other end parts of the sheet sheaves.

An image forming apparatus according to the third mode of the present disclosure includes a sheet processing device according to the above first or second mode and an image forming apparatus main body. The image forming apparatus main body forms an image on the sheets.

DETAILED DESCRIPTION

Figure 1:
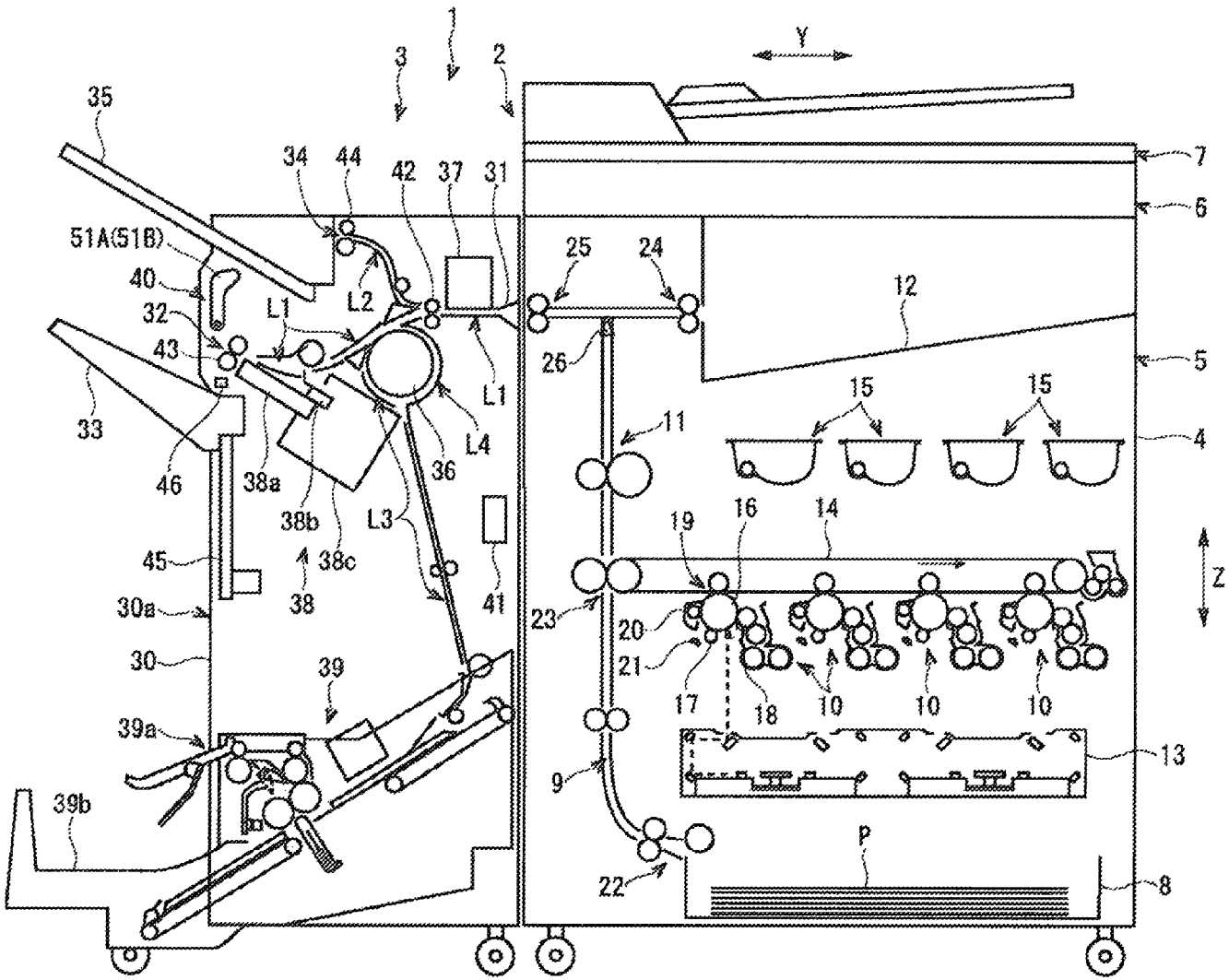
FIG. 1 is a cross sectional view schematically showing an image forming apparatus according to one embodiment of the present disclosure.

Embodiments of the present disclosure will be described below with reference to the accompanying drawings. It is noted that the same reference numerals denote the same or corresponding elements in the drawings, and the description thereof will not be repeated. The following description assumes for the sake of convenience that: the Y direction is an ejection direction in which a sheet P or a sheet sheaf S is ejected; the Z direction is a stacking direction or vertical direction in which a sheet P or a sheet sheaf S is stacked; and the X direction, which is orthogonal to the ejection direction and the stacking direction, is a shifting direction or back-and-forth direction. Further, a front Fr is set in each drawing. The X, Y, and Z directions are orthogonal to one another. In the present embodiment, the X and Y directions are parallel to the horizontal axis, while the Z direction is parallel to the perpendicular axis.

Figure 2:
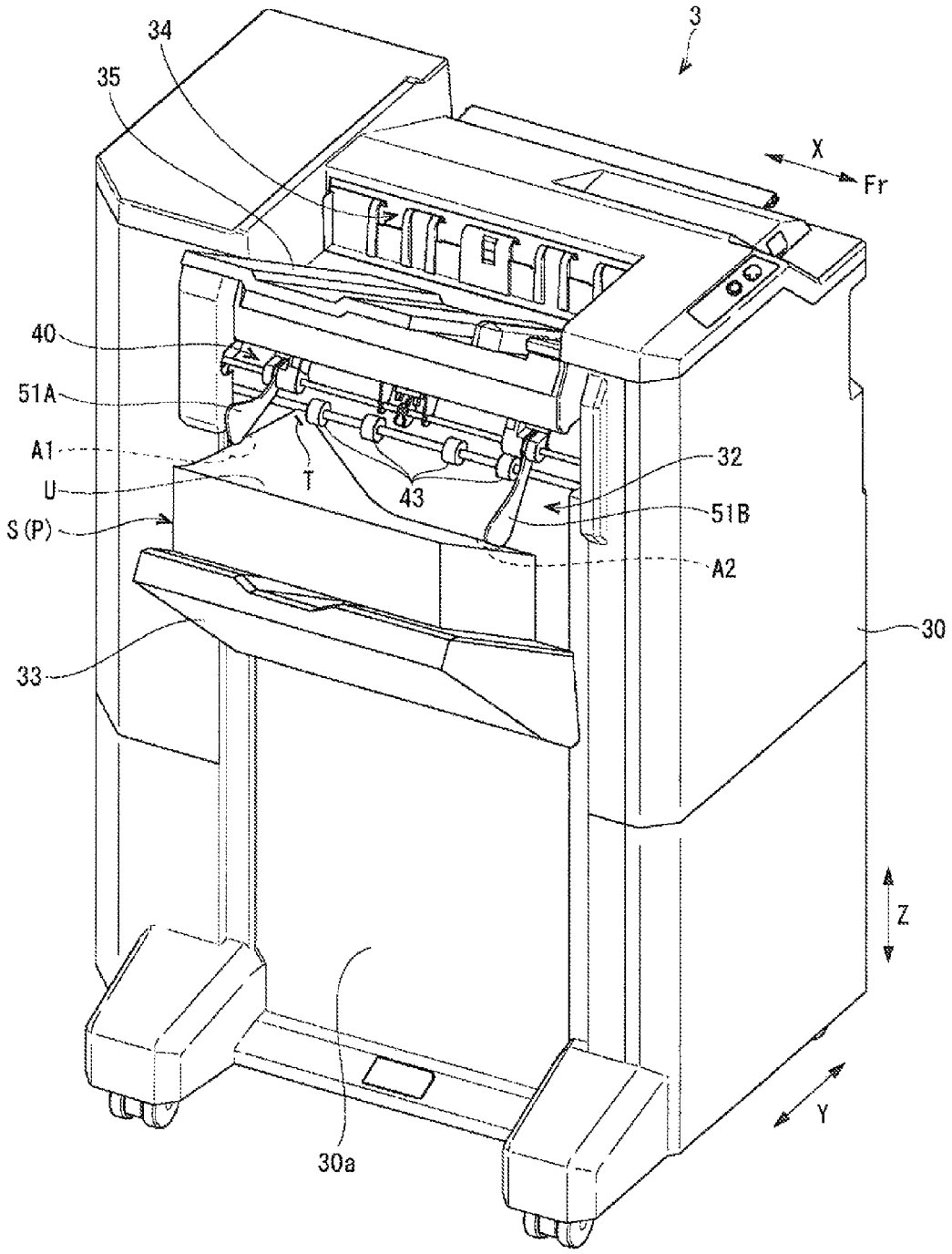
FIG. 2 is a perspective view showing a sheet processing device according to one embodiment of the present disclosure.

First of all, an overall configuration of an image forming apparatus 1 according to one embodiment of the present disclosure will be described with reference to FIGS. 1 and 2. FIG. 1 is a cross sectional view schematically showing the image forming apparatus 1. FIG. 2 is a perspective view showing a sheet processing device 3.

As shown in FIG. 1, the image forming apparatus 1 includes an image forming apparatus main body 2 and the sheet processing device 3. The image forming apparatus main body 2 forms an image on a sheet P. The sheet processing device 3 performs post processing on a sheet P on which an image is formed (printed).

The image forming apparatus main body 2 includes an apparatus main body 4 substantially in a box shape. In the interior of the apparatus main body 4, an image forming device 5, an image reading device 6 for reading an image of an original document, etc. are accommodated. Further, an auto document feeder (ADF) 7 is provided on top of the apparatus main body 4. The auto document feeder 7 automatically sends original documents on a sheet-by-sheet basis to an image reading position of the image reading device 6.

The image forming device 5 performs image forming processing on the basis of image data transmitted from a personal computer or the image reading device 6, for example. The image forming device 5 includes a sheet accommodating section 8, four image forming sections 10, a fusing device 11, and a sheet ejecting section 12. The sheet accommodating section 8 accommodates sheets P, such as copy paper. The four image forming sections 10 transfer toner images to a sheet P fed from the sheet accommodating section 8 to a conveyance path 9. The fusing device 11 fuses toner images, which are transferred to a sheet P, to the sheet P. The sheet ejecting section 12 ejects a sheet P on which toner images are fused. It is noted that the sheet P is not limited to a recording medium of paper and may be a sheet-like recording medium, such as a resin film, an overhead projector (OHP) sheet, etc.

An exposure unit 13 including a laser scanning unit is arranged above the sheet accommodating section 8. An intermediate transfer belt 14 as an image bearing member is arranged above the exposure unit 13. The intermediate transfer belt 14 is wound between a plurality of rollers. Four toner containers 15 for the respective toner colors are provided above the intermediate transfer belt 14. Moreover, the four image forming sections 10 for the respective toner colors are provided along the lower side of the intermediate transfer belt 14.Z Each image forming section 10 includes a photosensitive drum 16, a charger 17, a developing device 18, a primary transfer section 19, a cleaner 20, and a static eliminator 21. The photosensitive drum 16 is provided rotatably. The charger 17, the developing device 18, the primary transfer section 19, the cleaner 20, and the static eliminator 21 are arranged around the photosensitive drum 16 in the order of the process of primary transfer.

The conveyance path 9 for a sheet P is formed in the interior of the apparatus main body 4. A feeding section 22 is provided at the upstream part of the conveyance path 9. The feeding section 22 takes out a sheet P from the sheet accommodating section 8. A secondary transfer section 23 is provided at the rear end of the intermediate transfer belt 14 in the midstream of the conveyance path 9. The fusing device 11 is provided downstream of the secondary transfer section 23 in the conveyance path 9. The fusing device 11 includes a heating roller and a pressure roller.

A switching section 26 is provided at the downstream end of the conveyance path 9. The switching section 26 switches the conveyance direction of a sheet P between a direction toward a first sheet ejecting section 24 and a direction toward a second sheet ejecting section 25. A sheet P ejected outside the apparatus main body 4 from the first sheet ejecting section 24 is stacked on the sheet ejecting section 12. By contrast, a sheet P ejected outside the apparatus main body 4 from the second sheet ejecting section 25 is conveyed to the interior of the sheet processing device 3.

It is noted that the image reading device 6 and the auto document feeder 7 have the same configurations as a general image reading device and a general auto document feeder which have their functions, respectively. Therefore, description of them is omitted.

Description will be made about an image forming operation by the image forming apparatus main body 2. When image data (instruction to start printing) is input from a computer connected to the image forming apparatus main body 2 or the image reading device 6, each exposure device 13 first performs exposure according to image data on the surface of the corresponding photosensitive drum 16 charged by the corresponding charger 17. Then, each developing device 18 develops an electrostatic latent image formed on the surface of the corresponding photosensitive drum 16 to obtain a toner image in a corresponding color. Each primary transfer section 19 primarily transfers the corresponding toner image to the intermediate transfer belt 14. The above operation by the image forming sections 10 forms a full color toner image on the intermediate transfer belt 14. Each cleaner 20 and each static eliminator 21 remove residual toner and electrical charges on the corresponding photosensitive drum 16.

By contrast, a sheet P taken out from the sheet accommodating section 8 by the feeding section 22 is conveyed to the secondary transfer section 23 in synchronization with the aforementioned image forming operation. The full color toner image on the intermediate transfer belt 14 is secondary transferred to the sheet P. Then, the sheet P is conveyed to the fusing device 11 through the conveyance path 9. The sheet P to which the toner images are fused by the fusing device 11 enters the first or second sheet ejecting section 24 or 25 and is ejected to the sheet ejecting section 12 or in the interior of the sheet processing device 3.

The sheet processing device 3 will be described next. The sheet processing device 3 conveys each of sheets P ejected from the second sheet ejecting section 25 of the image forming apparatus main body 2 to the interior of its box body 30 and performs post processing on the sheet P, such as stapling, perforation, folding, etc.

As shown in FIGS. 1 and 2, the sheet processing device 3 includes the box body 30 substantially in a box shape, a carry in section 31, a main exit tray (exit tray) 33, a sub exit tray 35, a holding drum 36, a variety of conveyance path switching members, a variety of rollers, etc. Each sheet P ejected from the second sheet ejecting section 25 is conveyed to the carry in section 31. Sheets P ejected from the main ejection section 32 or sheet sheaves S ejected after subjected to stapling are stacked on the main exit tray 33. The sub exit tray 35 receives each sheet P ejected from a sub ejection section 34. The holding drum 36 temporarily withdraws a sheet P to a preset conveyance path.

Further, the sheet processing device 3 includes a puncher 37, a stapler 38, a sheet folder 39, a sheet alignment mechanism 40, and a controller 41. The puncher 37 performs perforation on a sheet P. The stapler 38 stacks a plurality of sheets P and staples them with a needle (staple). The sheet folder 39 folds a sheet P. The sheet alignment mechanism 40 moves at least sheets P stacked on the main exit tray 33 in the shifting direction for alignment. The shifting direction is orthogonal to the ejection and stacking directions of a sheet P. In the present embodiment, the sheet alignment mechanism 40 also moves sheet sheaves S stacked on the main exit tray 33 in the shifting direction for alignment. The controller 41 controls each device and mechanism.

A first conveyance path L1 extending from the carry in section 31 is connected to the main ejection section 32 provided at the upper part of a side wall 30*a* of the box body 30. A second conveyance path L2 branching from the first conveyance path L1 is connected to the sub ejection section 34 provided at the upper part of the box body 30. Moreover, a third conveyance path L3 branching from the first conveyance path L1 is connected to the sheet folder 39. In addition, a fourth conveyance path L4 branching from the third conveyance path L3 is curved along the circumference of the holding drum 36 and is merged into the first conveyance path L1.

A sheet P carried from the carry in section 31 is sent out downstream by an intermediate roller pair 42. A plurality of main ejection section roller pairs 43 are provided at the terminal end of the first conveyance path L1. It is noted that only each one roller of the main ejection section roller pairs 43 is shown in FIG. 2, and the other rollers are omitted. The main ejection section roller pairs 43 serve as an ejection mechanism that sends out a sheet P or a sheet sheaf S to the main exit tray 33. Each one of the plurality of main ejection section roller pairs 43 is fixed to a roller shaft extending in the shifting direction above the main exit tray 33. Each of the others of the plurality of main ejection section roller pairs 43 is fixed to a roller shaft extending in the shifting direction.

In order to send out a sheet P to the stapler 38, each one of the main ejection section roller pairs 43 separates from the other corresponding one thereof to release the nip. On the main exit tray 33, a sheaf of sheets P (a sheet sheaf S), which is subjected to stapling by the stapler 38, is stacked. It is noted that a sheet P not subjected to post processing or a sheet P subjected to only perforation may be stacked on the main exit tray 33.

The main exit tray 33 extends outward and upward from the side wall 30*a* of the box body 30. FIG. 1 shows a state in which the main exit tray 33 is located at a home position (the topmost level). The main exit tray 33 is lifted up and down in the vertical direction along the side wall 30*a* by controlling and driving a lifting controller 45. Further, an upper limit sensor 46 is provided in the vicinity under the main ejection section roller pairs 43. The upper limit sensor 46 monitors the height of sheets P or sheet sheaves S ejected and stacked on the main exit tray 33.

Specifically, the upper limit sensor 46 is arranged at a preset position of the sheet processing device 3 (hereinafter referred to as "preset position L"). The preset position L is located outside the base end of the main exit tray 33 in the shifting direction and above the base end part of the main exit tray 33. The upper limit sensor 46 monitors in the shifting direction the height of stacked sheet sheaves S or stacked sheets P from the preset position L. Upon detection of the fact that the total height of a plurality of sheet sheaves S or a plurality of sheets P exceeds the preset position L, the upper limit sensor 46 outputs a detection signal to the controller 41 (a control section 41*a*).

A sub ejecting section roller pair 44 are provided at the terminal end of the second conveyance path L2. The sub ejecting section roller pair 44 sends out a sheet P to the sub exit tray 35. A sheet P not subjected to post processing in the sheet processing device 3 or sheets P subjected to only perforation may be stacked mainly on the sub exit tray 35.

The holding drum 36 conveys a sheet P conveyed in the third conveyance path L3 to the fourth conveyance path L4 and circulates it through the first conveyance path L1. That is, the holding drum 36 keeps the first sheet P or the plural sheets P of a preset number of sheets P, which are to be subjected to stapling next, waiting until currently performed stapling is finished.

The puncher 37 is arranged between the carry in section 31 and the intermediate roller pair 42 to face the first conveyance path L1 from above. The puncher 37 performs perforation on a sheet P conveyed through the first conveyance path L1 with preset timing.

The stapler 38 includes a tray 38*a*, a claw member 38*b*, and a stapling section 38*c*. A preset number of sheets P are stacked on the tray 38*a*. The claw member 38*b* aligns the edge of the stacked sheets P. The stapling section 38*c* staples the preset number of sheets P, of which edge is aligned, with the use of a staple. As a result, the preset number of sheets P stapled with the staple, that is, a sheet sheaf S is obtained. Hereinafter, a staple that staples a sheet sheaf S may be referred to as a staple part T. A sheet sheaf S is conveyed up to the main ejection section roller pairs 43 by the claw member 38*b*, which moves along the tray 38*a*, and is ejected to the main exit tray 33 by the main ejection section roller pairs 43.

The sheet folder 39 is provided on the downstream side of the third conveyance path L3. The sheet folder 39 performs folding to fold an introduced sheet P or sheet sheaf S in half or twice. The folded sheet P or sheet sheaf S is ejected to the lower exit tray 39*b* through the lower ejection section 39*a*.

Figure 3:
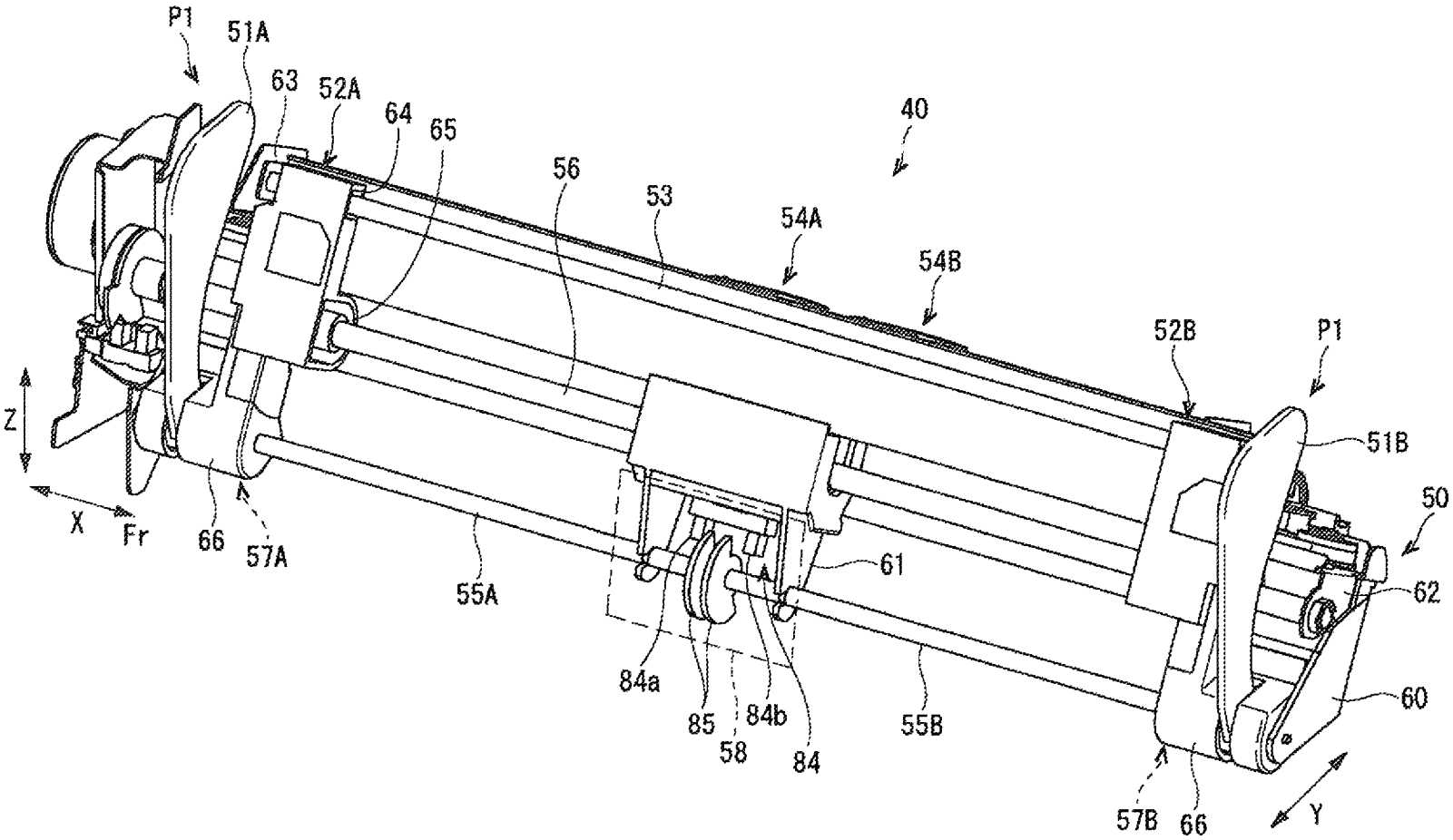
FIG. 3 is a perspective view of a sheet alignment mechanism of the sheet processing device according to one embodiment of the present disclosure, and shows a state in which alignment members are located at respective home positions.
Figure 4:
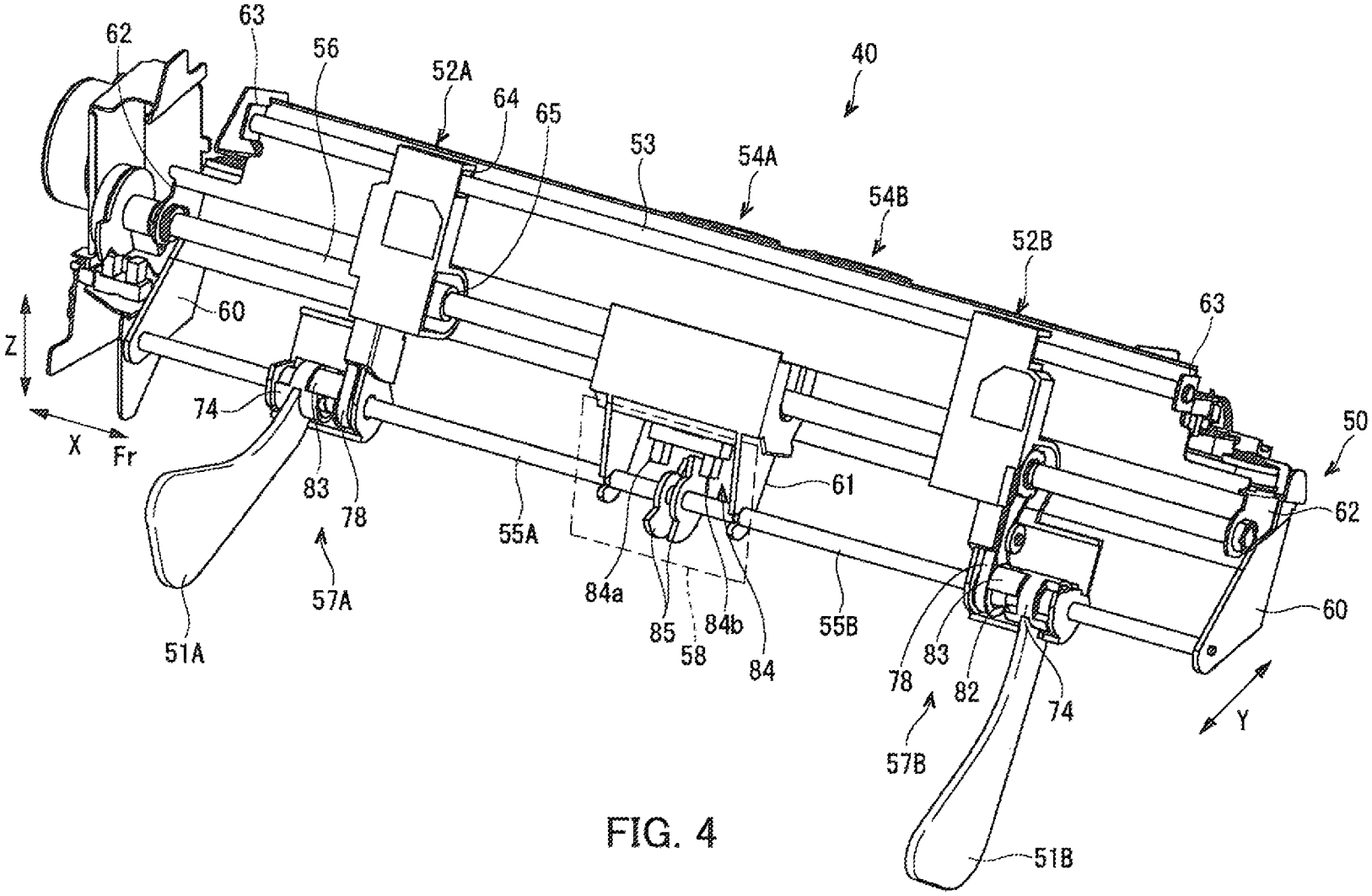
FIG. 4 is a perspective view of the sheet alignment mechanism of the sheet processing device according to one embodiment of the present disclosure, and shows a state in which the alignment member are located at respective detection positions.
Figure 5:
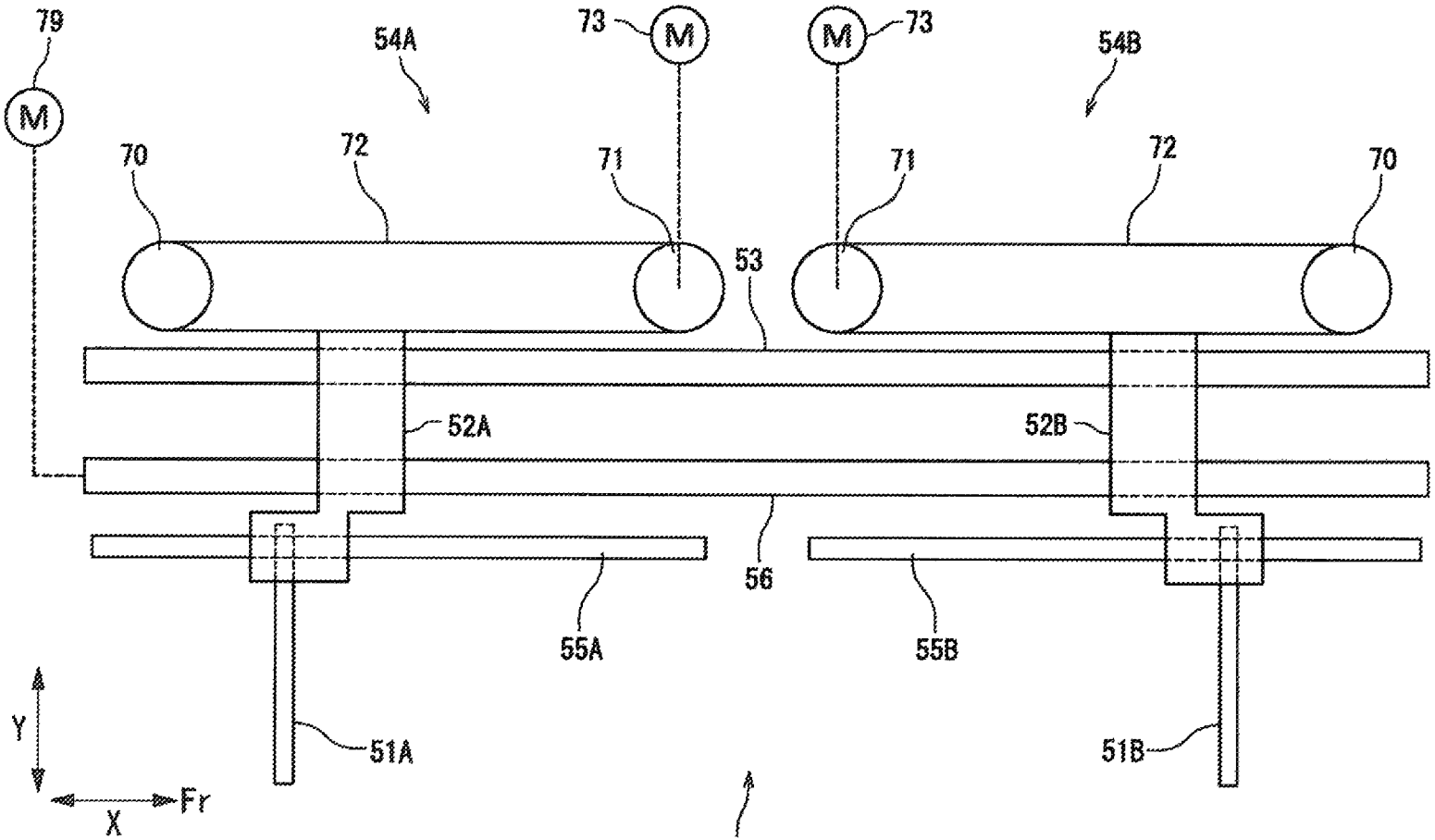
FIG. 5 is a plan view schematically showing moving mechanisms of the sheet processing device according to one embodiment of the present disclosure.
Figure 6:
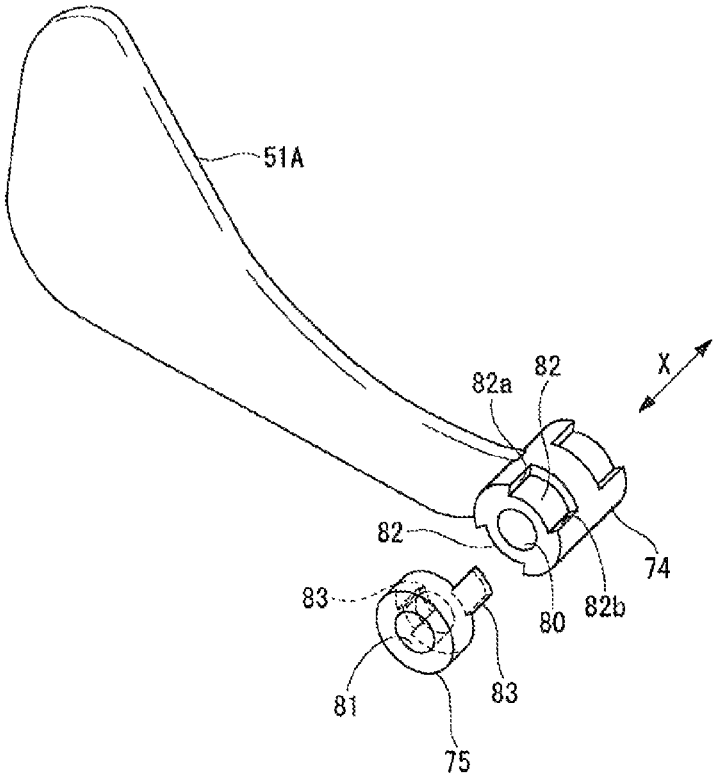
FIG. 6 is an exploded perspective view showing a part of one of rotation mechanisms of the sheet processing device according to one embodiment of the present disclosure.
Figure 7:
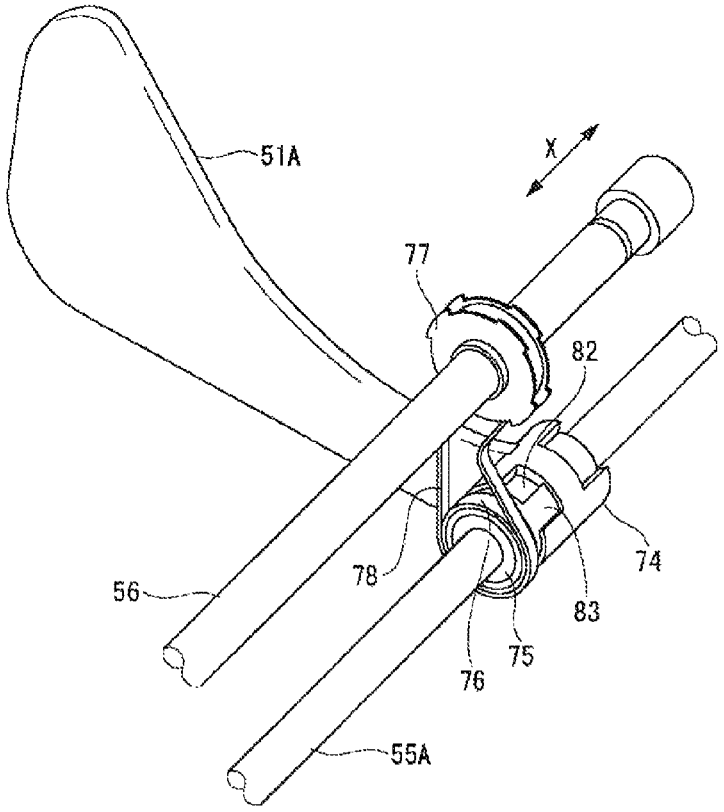
FIG. 7 is a perspective view showing the rotation mechanism of the sheet processing device according to one embodiment of the present disclosure.

With reference to FIGS. 2-7, the sheet alignment mechanism 40 will be described next. FIGS. 3 and 4 are perspective views showing the sheet alignment mechanism 40. FIG. 5 is a plan view schematically showing moving mechanisms 54A and 54B. FIGS. 6 and 7 are perspective views showing a rotation mechanism 57A.

As shown in FIG. 2, the sheet alignment mechanism 40 is arranged above the main ejection section roller pairs 43 in the main ejection section 32.

As shown in FIGS. 2-4, the sheet alignment mechanism 40 includes a mechanism main body 50, a pair of alignment members 51A and 51B, a pair of a pedestals 52A and 52B, a rail 53, a pair of moving mechanisms 54A and 54B, a pair of rotary shafts 55A and 55B, a rotary shaft 56, a pair of rotation mechanisms 57A and 57B, and a detection mechanism 58.

The pair of alignment members 51A and 51B are independently rotatable about an axial line in the shifting direction. The pair of alignment members 51A and 51B are at least capable of coming into contact with the respective opposite end parts of sheets P in the shifting direction. In the present embodiment, the pair of alignment members 51A and 51B are also capable of coming in contact with the respective opposite end parts of sheet sheaves S in the shifting direction. The pedestals 52A and 52B support the alignment members 51A and 51B, respectively. The rail 53 supports the pair of alignment members 51A and 51B movably in the shifting direction through the pair of pedestals 52A and 52B, respectively. The pair of moving mechanisms 54A and 54B move the pair of alignment members 51A and 51B in the shifting direction, respectively. Specifically, the moving mechanisms 54A and 54B move the alignment members 51A and 51B, respectively, along the rail 53.

The rotary shaft 55A and the rotary shaft 56 support the alignment member 51A rotatably. The rotary shaft 55B and the rotary shaft 56 support the alignment member 51B rotatably. The rotation mechanisms 57A and 57B rotate the alignment members 51A and 51B in the stacking direction about the rotary shafts 55A and 55B extending in the shifting direction above the main exit tray 33, respectively. The alignment member 51A is arranged correspondingly to the rear end parts (one end parts in the shifting direction) of sheet sheaves S. In other words, the alignment member 51A is arranged on the rear end side (one end side) of sheet sheaves S. The alignment member 51B is arranged correspondingly to the front end parts (the other end parts in the shifting direction) of the sheet sheaves S. In other words, the alignment member 51B is arranged on the front end side (the other end side) of sheet sheaves S. The detection mechanism 58 detects a difference in amount of rotation between the alignment members 51A and 51B. Specifically, the detection mechanism 58 detects a difference in amount of rotation between the rear alignment member 51A rotated by the rotation mechanism 57A and the front alignment member 51B rotated by the rotation mechanism 57B.

The terms, "rear" and "front" in "rear end side" and "front end side" hereinafter mean the rear and the front of each sheet P or each sheet sheaf S stacked on the main exit tray 33 in the shifting direction, respectively.

As shown in FIGS. 3 and 4, the mechanism main body 50 includes a pair of first support members 60, an intermediate support member 61, a pair of second support members 62, and a pair of third support members 63. The pair of first support members 60 are provided at the opposite ends of the mechanism main body 50 in the shifting direction. The intermediate support member 61 is provided at the central part of the mechanism main body 50 in the shifting direction. The pair of second support members 62 are provided above the pair of first support members 60. The pair of third support members 63 are provided above the pair of second support members 62.

As shown in FIGS. 3 and 4, the rotary shafts 55A and 55B extend in the shifting direction. The rotary shafts 55A and 55B are arranged side by side in the shifting direction. The inside ends of the rotary shafts 55A and 55B which face each other are not connected together and are arranged with a preset space apart from each other. The intermediate support member 61 supports the inside ends of the rotary shafts 55A and 55B. The outside ends of the rotary shafts 55A and 55B are supported by one and the other of the pair of first support members 60, respectively. The rotary shafts 55A and 55B are independently provided so as to be rotatable about the axial line in the shifting direction. The rotary shaft 56 is provided above and in parallel to the rotary shafts 55A and 55B. The opposite ends of the rotary shaft 56 are supported by the pair of second support members 62 to be rotatable about the axial line. The rail 53 is provided above and in parallel to the rotary shaft 56. The opposite ends of the rail 53 are fixed to the pair of third support members 63.

The alignment members 51A and 51B each are substantially a plate-like shape and include a flat portion extending in the stacking direction and the ejection direction. The alignment members 51A and 51B are each formed to have a smaller base end part and larger distal end part. The flat portions of the alignment members 51A and 51B are configured to press the rear and front end parts of each sheet P, respectively.

It is noted that the alignment members 51A and 51B have substantially the same configuration. Therefore, description will focus only on the rear alignment member 51A, while description of the front alignment member 51B is omitted. Similarly, description will focus on each rear one, and description of each front one is omitted as for the pedestals 52A and 52B, the moving mechanisms 54A and 54B, and the rotation mechanisms 57A and 57B. Further, the same numerals are assigned as reference signs to the corresponding rear and front element pairs with the letters "A" and "B" attached to the rear and front elements, respectively.

The base end part of the rear alignment member 51A is mounted on the rotary shaft 55A to be relatively non-rotatable and movable along the rotary shaft 55A. This can allow the alignment member 51A to rotate integrally with the rotary shaft 55A and slide in the shifting direction.

The rear pedestal 52A is mounted to be movable along the rail 53, the rotary shaft 56, and the rotary shaft 55A. Specifically, a first penetrating part 64 through which the rail 53 passes in the shifting direction and a second penetrating part 65 through which the rotary shaft 56 passes in the shifting direction are formed in the pedestal 52A. Further, the alignment member 51A and the rotation mechanism 57A (which will be described later in detail) that makes the alignment member 51A to rotate are boarded at the lower part of the pedestal 52A. It is noted that the rotation mechanism 57A is covered with a cover 66 (see FIG. 3). FIG. 4 shows the state in which the cover 66 is taken away.

As shown in FIG. 5, the rear moving mechanism 54A includes a driven pulley 70, a drive pulley 71, a shifting timing belt 72, and a shifting drive section (stepping motor or the like) 73. The driven pulley 70 is pivotally supported by the second support member 62. The drive pulley 71 is pivotally supported on the intermediate support member 61. The sifting timing belt 72 is wound between the driven pulley 70 and the drive pulley 71. The shifting drive section 73 rotates the drive pulley 71.

The pedestal 52A is fixed to the shifting timing belt 72. Accordingly, when the shifting drive section 73 is driven, the moving mechanism 54A moves the pedestal 52A in parallel to the shifting direction along the rail 53. That is, the pair of pedestal 52A and the alignment member 51A and the pair of pedestal 552B and the alignment member 51B are independently movable.

As shown in FIGS. 4, 6, and 7, the rear rotation mechanism 57A includes substantially cylindrical first and second hubs 74 and 75, lower and upper pulleys 76 and 77, a rotation timing belt 78, and a rotation drive section (stepping motor or the like) 79 (see FIG. 5). The first hub 74 is formed integrally with the base end part of the alignment member 51A. The second hub 75 is connected to the first hub 74 relatively rotatably. The lower pulley 76 is fixed to the second hub 75.

The upper pulley 77 is mounted on the rotary shaft 56 to be relatively non-rotatable and movable along the rotary shaft 56. In one example, the rotary shaft 56 may be formed to have a non-circular shape in cross section (e.g., D-shape), while the hole of the upper pulley 77 may be in a shape that agrees with the shape of the rotary shaft 56 in cross section. The rotation timing belt 78 is wound between the lower pulley 76 and the upper pulley 77. The rotation drive section 79 rotates the upper pulley 77 through the rotary shaft 56.

As shown in FIGS. 6 and 7, the rotary shaft 55A is relatively non-rotatably inserted through a first through hole 80 formed in the first hub 74. In one example, the rotary shaft 55A may be formed to have a non-circular shape in cross section (e.g., D-shape), while the first through hole 80 may be in a shape that agrees with the shape of the rotary shaft 55A in cross section. This can make the alignment member 51A to be non-rotatable relative to and movable along the rotary shaft 55A.

The rotary shaft 55A is rotatably inserted through a second through hole 81 formed in the second hub 75. A stepped part 82 is formed in a circumferential direction at an end part of the first hub 74. The stepped part 82 has a length of about one fourth of the circumference of the first hub 74. A protrusion 83 extending in the shifting direction is formed at one end of the second hub 75. The end of the first hub 74 is in contact with the end of the second hub 75 so that the protrusion 83 is inserted in the stepped part 82 in a movable state in the circumferential direction (with play). Accordingly, the first hub 74 is connected to the second hub 75 relatively rotatably by a preset angle. In other words, the alignment member 51A has play in rotation.

When the rotation drive section 79 is driven, the rotational force is transmitted to the second hub 75 through the rotary shaft 56, the upper pulley 77, the rotation timing belt 78, and the lower pulley 76. The rotation of the second hub 75 accompanies rotation of the protrusion 83. The protrusion 83 is in contact with a front end 82*a* or a rear end 82*b* of the stepped part 82 of the first hub 74 to rotate the alignment member 51A together with the rotary shaft 55A.

As shown in FIGS. 3 and 4, the detection mechanism 58 is arranged between the alignment members 51A and 51B. The detection mechanism 58 includes a photointerrupter 84 (sensor) fixed on the intermediate support member 61 and a pair of to-be-detected members 85. One and the other of the pair of to-be-detected members 85 are mounted non-rotatably on the rotary shafts 55A and 55B, respectively. Specifically, the one and the other of the pair of to-be-detected members 85 are fixed on the inside ends of the rotary shafts 55A and 55B, respectively.

The photointerrupter 84 detects a difference in amount of rotation between the one and the other of the pair of to-be-detected members 85. Specifically, the photointerrupter 84 includes a light emitting element 84*a* and a light receiving element 84*b*. The photointerrupter 84 is mounted on the intermediate support member 61. The light emitting element 84*a* and the light receiving element 84*b* are arranged with a preset space apart from each other.

The pair of to-be-detected members 85 are arranged between the light emitting element 84*a* and the light receiving element 84*b*. The pair of to-be-detected members 85 have the same shape, which is formed by cutting out a part of a disk-shaped member into a fan shape.

Figure 8:
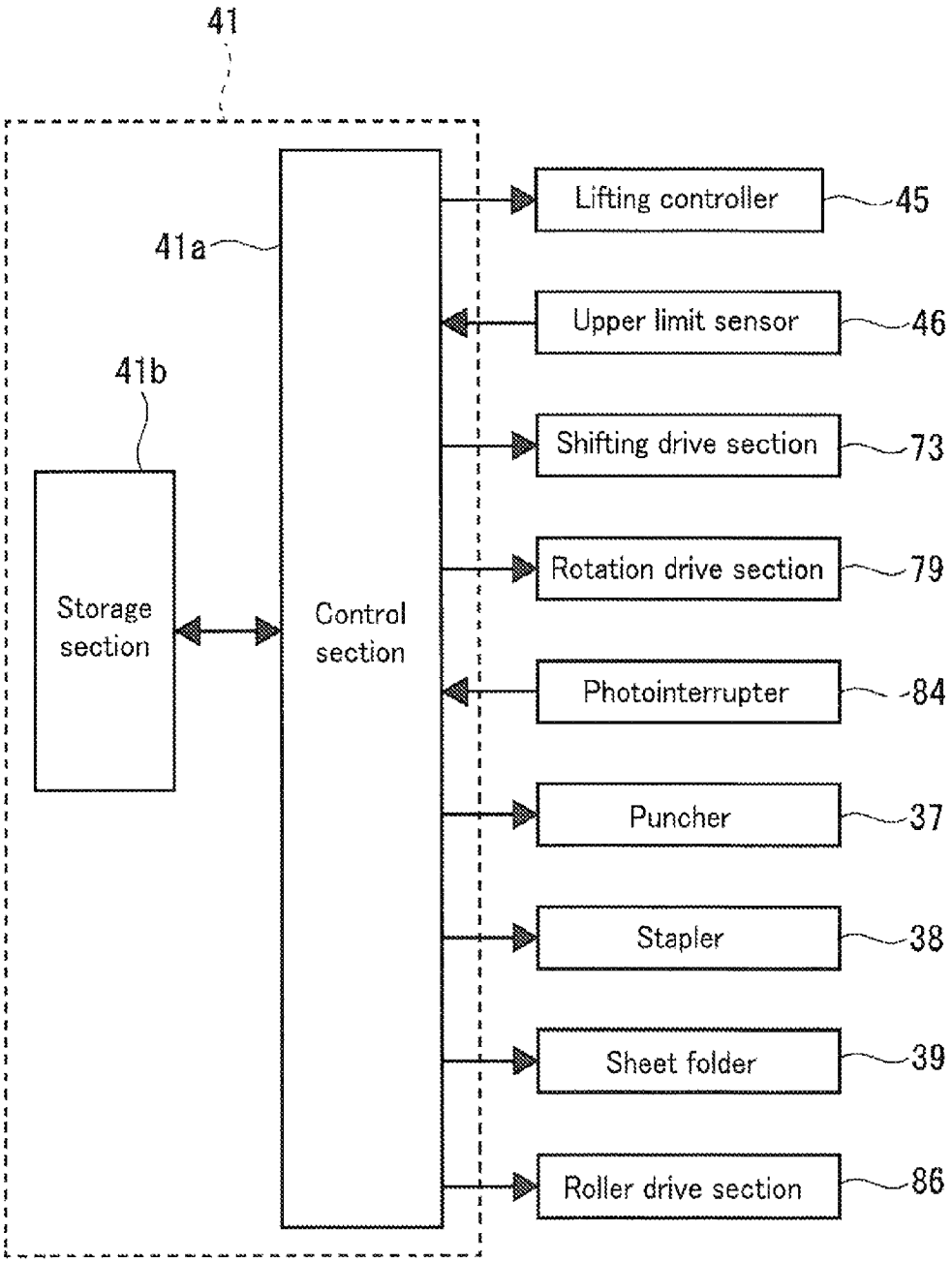
FIG. 8 is a block diagram showing a configuration of a controller of the sheet processing device according to one embodiment of the present disclosure.

With reference to FIG. 8, the controller 41 will be described next. FIG. 8 is a block diagram showing a configuration of the controller 41.

The controller 41 includes a control section 41*a*, which includes a CPU and an input/output interface, and a storage section 41*b* as storage, such as a ROM and RAM.

The control section 41*a* is in electrical connection with the lifting controller 45, the upper limit sensor 46, the shifting drive section 73, the rotation drive section 79, the photointerrupter 84, the puncher 37, the stapler 38, the sheet folder 39, a roller drive section 86, etc. It is noted that though not described, the control section 41*a* is also connected to other elements for total control on the sheet processing device 3. The control section 41*a* controls connected elements on the basis of a control program and control data stored in the storage section 41*b*. The storage section 41*b* stores the types and thicknesses of sheets P, a preset value (given value RT which will be described later) that the detection mechanism 58 utilizes, etc.

Figure 9:
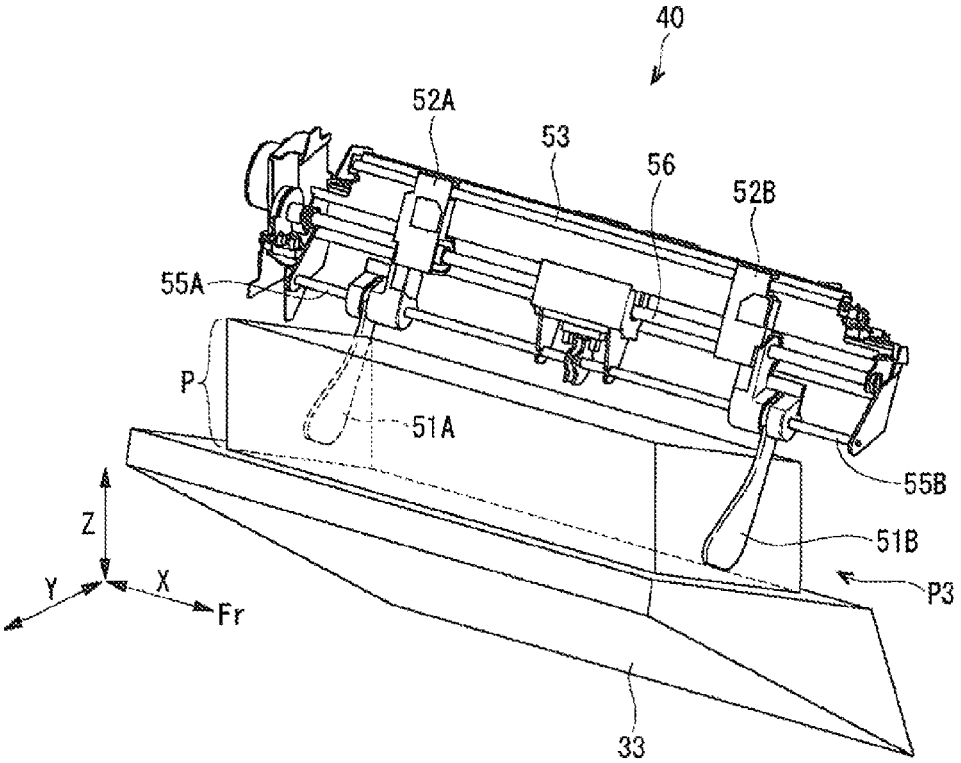
FIG. 9 is a perspective view for explaining sheet alignment in the sheet alignment mechanism of the sheet processing device according to one embodiment of the present disclosure.
Figure 10:
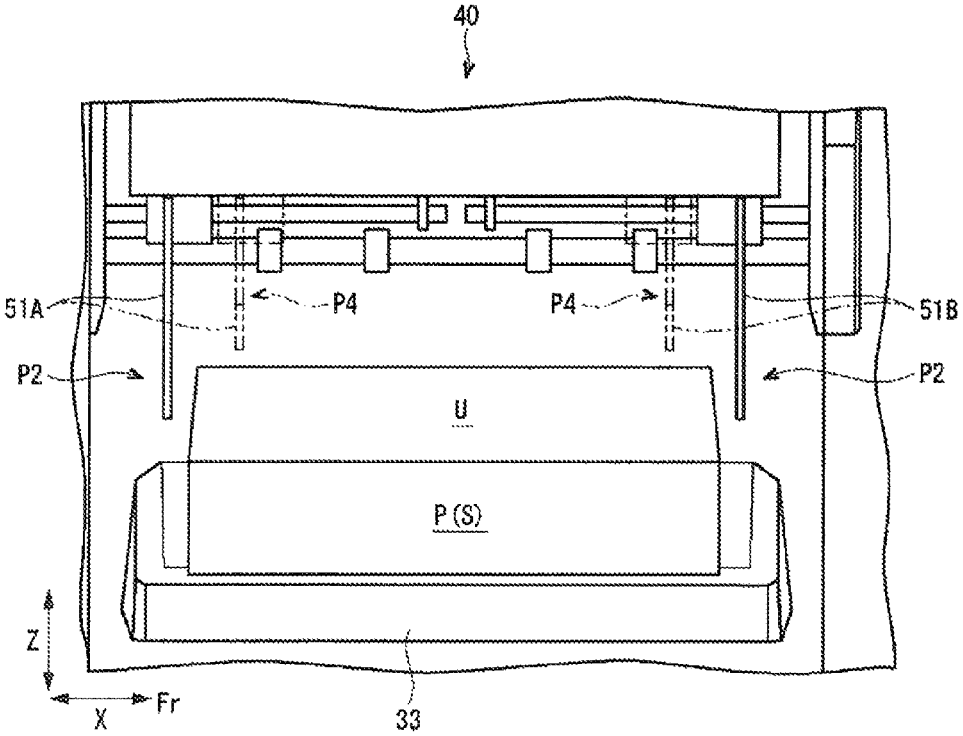
FIG. 10 is a side view of the sheet alignment mechanism of the sheet processing device according to one embodiment of the present disclosure, and shows a state in which the alignment members are located at respective escape positions or respective standby positions.
Figure 11:
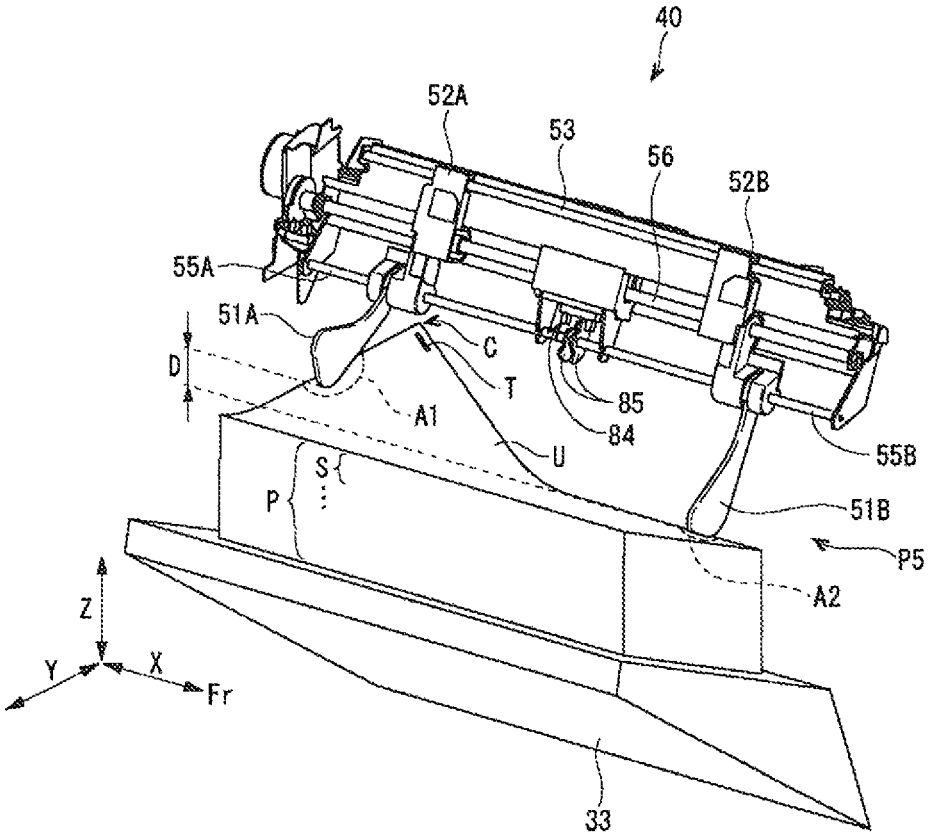
FIG. 11 is a perspective view for explaining height detection of sheet sheaves in the sheet alignment mechanism of the sheet processing device according to one embodiment of the present disclosure.
Figure 12:
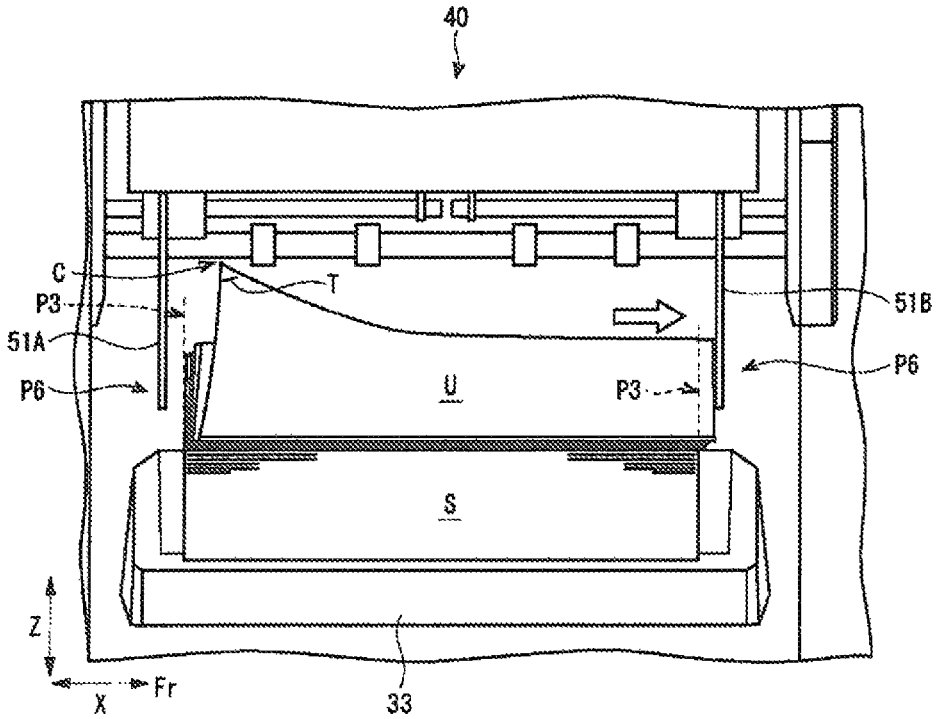
FIG. 12 is a side view for explaining an operation for preventing collapse of sheet sheaves in the sheet alignment mechanism of the sheet processing device according to one embodiment of the present disclosure.

With reference to FIGS. 3, 4, and 9-12, control on the sheet alignment mechanism 40 by the controller 41 will be described next. FIG. 9 is a perspective view for explaining alignment performed on sheets P. FIG. 10 is a side view of the sheet alignment mechanism 40, and shows a state in which the alignment members 51A and 51B are positioned at escape positions P2 or standby positions P4. FIG. 11 is a perspective view for explaining height detection performed on sheet sheaves S. FIG. 12 is a side view for explaining an operation for preventing collapse of sheet sheaves S.

Home positions P1, the escape positions P2, and reference positions P3 are defined as follows. As shown in FIGS. 1 and 3, the home positions P1 are positions where the alignment members 51A and 51B are accommodated in the box body 30 in a standing-up posture with their distal edges facing upward. As shown in FIG. 10, the escape positions P2 are positions where the pair of alignment members 51A and 51B are distant from the opposite edges of sheets P or sheet sheaves S in the shifting direction ejected to the main exit tray 33. Specifically, the escape position P2 of the alignment member 51A is a position where the alignment member 51A is separate in the shifting direction from the rear end parts (one end parts in the shifting direction) of sheets P or sheet sheaves S. The escape position P2 of the alignment member 51B is a position where the alignment member 51B is separate in the shifting direction from the front end parts (other end parts in the shifting direction) of sheets P or sheet sheaves S.

As shown in FIG. 9, the reference positions P3 are positions where the pair of alignment members 51A and 51B are in contact with the opposite end parts of sheets P or sheet sheaves S ejected to the main exit tray 33. Specifically, the reference position P3 of the alignment member 51A is a position where the alignment member 51A is in contact with the rear end parts (one end parts in the shifting direction) of sheets P or sheet sheaves S. The reference position P3 of the alignment member 51B is a position where the alignment member 51B is in contact with the front end parts (other end parts in the shifting direction) of sheets P or sheet sheaves S. It is noted that, as shown in FIG. 3, the alignment members 51A and 51B at the home positions P1 are positioned at the outer ends of the rotary shafts 55A and 55B, respectively, so as to be distant from each other.

With reference to FIGS. 9 and 10, description will be made first about the alignment to align sheets P ejected to the main exit tray 33.

The controller 41 (control section 41*a*) drives and control the rotation drive section 79 to rotate the alignment members 51A and 51B from the home positions P1 to the escape positions P2 (see FIG. 10). It is noted that since the escape positions P2 differ according to the size of a to-be-ejected sheet P (e.g., A4 or B5 size), the controller 41 drives and control the shifting drive section 73 to independently move the alignment members 51A and 51B to the positions according to the size of a sheet P.

Then, the controller 41 drives and controls the shifting drive section 73 to move the alignment members 51A and 51B in the shifting direction from the escape positions P2 to the reference positions P3 (see FIG. 9). Accordingly, the alignment members 51A and 51B are moved along the rail 53 and the like to align a plurality of sheets P by catching the opposite edges of the sheets P. Further, the sheet alignment mechanism 40 can perform alignment on a plurality of sheet sheaves S in a similar manner. It is noted that the sheet alignment mechanism 40 can also perform sorting for sorting and stacking a plurality of sheets P by displacing them in the shifting direction per print instruction (job). In this case, the sheet alignment mechanism 40 performs alignment on each sheaf of sorted sheets P.

With reference to FIGS. 10-12, description will be made next about the height detection to detect the height of sheet sheaves S ejected to the main exit tray 33. The standby positions P4 and detection positions P5 will be defined. As shown in FIG. 10, the standby positions P4 are positions where the alignment members 51A and 51B move to above a topmost surface U of sheet sheaves S ejected to the main exit tray 33. Specifically, the standby position P4 of the alignment member 51A is a position where the alignment member 51A moves to above a first point A1 on the topmost surface U. The standby position P4 of the alignment member 51B is a position where the alignment member 51B moves to above a second point A2 on the topmost surface U.

As shown in FIG. 11, the detection position P5 of the alignment member 51A is a position where the alignment member 51A comes in contact with the first point A1. The detection position P5 of the alignment member 51B is a position where the alignment member 51B comes in contact with the second point A2. The first point A1 is closer to the rear end parts (one end parts in shifting direction) of sheet sheaves S than the second point A2, while the second point A2 is closer to the front end parts (the other end parts in shifting direction) of the sheet sheaves S than the first point A1.

First, the controller 41 (the control section 41*a*) drives and controls the stapler 38, the main ejection section roller pairs 43, and the like to eject each sheet sheaf S to the main exit tray 33. Herein, each sheet sheaf S is subjected to one-point stapling. In so doing, each sheet sheaf S is ejected so that one side of the four sides of each sheet sheaf S in a rectangular shape, which is the closest to a staple part T when viewed in plan, is the tail end side. Accordingly, the sheet sheaves S are stacked on the main exit tray 33 so that the one side the closest to the staple part T comes in contact with the side wall 30*a* (see FIG. 2). The one side the closest to the staple part T is either one of the two sides that form a corner where the staple part is located. It is noted that the corner on the rear end side of each sheet sheaf S is subjected to stapling in the present embodiment. In other words, the staple part T is located in the corner on the rear end side of a sheet sheaf S.

The controller 41 drives and controls the rotation drive section 79 and the shifting drive section 73 to move the alignment members 51A and 51B from the home positions P1 to the standby positions P4 (see the dashed and double dotted lines in FIG. 10). Specifically, the controller 41 drives and controls the rotation drive section 79 to rotate the alignment members 51A and 51B by a preset angle from the home position P1 toward the main exit tray 33 and stop. It is noted that the amounts of rotation of the alignment members 51A and 51B are the same.

Then, the controller 41 drives and controls the shifting drive section 73 to move the alignment members 51A and 51B in the shifting direction according to the size of a sheet sheaf S. As a result, the alignment members 51A and 51B are moved to above the first point A1 and the second point A2 on the topmost surface U of the sheet sheaves S, respectively (see FIG. 2). In other words, the alignment members 51A and 51B are moved to the standby positions P4. The alignment members 51A and 51B at the standby positions P4 are positioned so as not to block sheet sheaf ejection.

Herein, the first point A1 is located in a region of the topmost surface U which is raised (hereinafter referred to as a raised region). The raised region is formed by accumulation of staple parts T formed by stapling. The second point A2 is located in a region of the topmost surface U which is flat (hereinafter referred to as a flat region). It is noted that the controller 41 preferably sets the alignment members 51A and 51B at positions 5-50 mm inside from the respective edges of a sheet sheaf S in the shifting direction. Arrangement of the alignment members 51A and 51B in the vicinity of the edges can result in detection of a height difference D where difference in height appears noticeably.

Subsequently, the controller 41 drives and control the rotation drive section 79 to rotate the alignment members 51A and 51B from the standby positions P4 to the detection positions P5 (see FIG. 11). Specifically, the controller 41 rotates the rear alignment member 51A from the standby position P4 up to the point where it comes in contact with the first point A1. Similarly, the controller 41 rotates the front alignment member 51B from the standby position P4 up to the point where it comes in contact with the second point A2. Specifically, the rotation mechanisms 57A and 57B (rotation drive section 79) rotate the alignment members 51A and 51B, respectively, so that the alignment members 51A and 51B come in contact with the vicinity of the opposite end parts of the topmost surface U of the sheet sheaves S in the shifting direction stacked on the main exit tray 33. In other words, the rotation mechanism 57A rotates the alignment member 51A so that the alignment member 51A arranged correspondingly to the rear end parts (one end parts in the shifting direction) of the sheet sheaves S comes in contact with the first point A1. On the other hand, the rotation mechanism 57B rotates the alignment member 51B so that the alignment member 51B arranged correspondingly to the front end parts (the other end parts in the shifting direction) of the sheet sheaves S comes in contact with the second point A2.

Accordingly, the detection mechanism 58 detects the difference in amount of rotation between the rear and front alignment members 51A and 51B. Then, the height difference D between the first point A1 and the second point A2 is detected on the basis of the detection result.

In the case where sheet sheaf ejection continues even after detection of the height difference D, the alignment members 51A and 51B at the detection positions P5 are reversely rotated to separate from the main exit tray 33 and move to the standby positions P4. Then, after a new sheet sheaf S is ejected, the alignment members 51A and 51B are rotated again toward the main exit tray 33 to move to the detection positions P5. Thereafter, the above operation is repeated until ejection of the last sheet sheaf S terminates. After termination of sheet sheaf ejection, the alignment members 51A and 51B are returned to the home position P1 (see FIG. 3).

Further, in the case of serial sheet sheaf ejection, the controller 41 drives and controls the lifting controller 45 to lift up/down the main exit tray 33. In other words, the lifting controller 45 lifts up or down the main exit tray 33 so that the height of the distal edge C (see FIG. 11) of sheet sheaves S is kept constant. Specifically, the lifting controller 45 lifts up or down the main exit tray 33 so that the distal edge C of the sheet sheaves S is kept always at a predetermined height from a preset reference. The distal edge C is a corner of the topmost surface U of the ejected sheet sheaves S, which is raised by accumulation of the staple parts T formed by stapling. In other words, the distal edge C is a raised corner of the corners of the topmost surface U of the sheet sheaves S, which is located closer to the base end part than to the distal end of the main exit tray 33. Further, the preset reference means at least one of the floor surface on which the sheet processing device 3 is placed, the lowermost level of the sheet processing device 3, the rotary shafts 55A and 55B, the rotary shaft 56, and any of the main ejection section roller pairs 43 (the ejection mechanism).

Specifically, the upper limit sensor 46 first detects the distal edge C of the ejected sheet sheaves S and then outputs the detection signal to the control section 41*a* of the controller 41. Upon receipt of the detection signal, the controller 41 drives and controls the lifting controller 45 to lift down the main exit tray 33 until the detection signal from the upper limit sensor 46 is not received. Next, the controller 41 drives and controls the lifting controller 45 to lift up the main exit tray 33 until the detection signal from the upper limit sensor 46 is output. Thus, the height of the distal edge C of the ejected sheet sheaves S stacked on the main exit tray 33 can be kept constant and substantially equal to the level of the upper limit sensor 46 (preset position L) regardless of the number of copies of the sheet sheaves S.

As described above, the height of the distal edge C can be controlled to be constant, thereby keeping the amount of rotation of the alignment member 51A between the standby position P4 and the first point A1 substantially constant. On the other hand, the height of the second point A2 varies according to the height difference D, so that the amount of rotation of the alignment member 51B varies according to the height difference D. Since the height of the distal edge C can be kept constant, the height difference D between the first point A1 with which the alignment member 51A comes in contact and the second point A2 with which the alignment member 51B comes in contact can be detected accurately with reference to the alignment member 51A coming in contact with the first point A1. Further, the main exit tray 33 can be lifted up and down according to the amount of ejected sheet sheaves S. This enables stacking of much more sheet sheaves S.

In comparison with the present embodiment, one example will be shown in which the alignment member 51A cannot serve as the reference because the height of the distal edge C is not constant. When the main exit tray 33 is lifted down to the position where the alignment member 51A is out of contact with the first point A1, the amounts of rotation of the alignment members 51A and 51B are the same even if the height difference D is an allowable limit. This means that the alignment member 51A cannot serve as the reference. Thus, the height difference D cannot be detected.

With reference to FIGS. 3 and 4, each movement of the rotation mechanisms 57A and 57B at rotation of the alignment members 51A and 51B will be described herein. In the following description, an interval from a rotation start of the alignment members 51A and 51B from the standby positions P4 to contact of the rear alignment member 51A with the first point A1 is defined as a "first stage". Also, an interval from the contact of the alignment member 51A with the first point A1 to contact of the front alignment member 51B with the second point A2 is defined as a "second stage".

First, in the first stage, the protrusion 83 of the second hub 75 formed at each base end part of the alignment members 51A and 51B is in contact with the rear end 82*b* of the stepped part 82 of the first hub 74. In the second stage, the alignment member 51B is rotated with the protrusion 83 being in contact with the rear end 82*b* until the alignment member 51B comes in contact with the second point A2 (see the protrusion 83 of the alignment member 51B shown in FIG. 4). On the other hand, in the second stage, contact of the alignment member 51A with the first point A1 restricts further rotation of itself. However, since the protrusion 83 is inserted in the stepped part 82 with play provided, the lower pulley 76 and the second hub 75 corresponding to the alignment member 51A can rotate until the protrusion 83 comes in contact with the front end 82*a* of the stepped part 82 (see the protrusion 83 of the alignment member 51A shown in FIG. 4). Thus, no rotational force is transmitted to the alignment member 51A, thereby suppressing application of an excessive load to the alignment member 51A.

The necessity of the play will be described here in relation to the rotary shaft 56. The rotary shaft 56 rotates the alignment members 51A and 51B in the stacking direction. Thus, the amount of rotation of the lower pulley 76 corresponding to the alignment member 51A is the same as that of the lower pulley 76 corresponding to the alignment member 51B. Accordingly, in order to make the difference in amount of rotation between the alignment members 51A and 51B according to the height difference D, the play is necessary.

Additional description will be made about the amount of play of the stepped part 82 relative to the protrusion 83. When assuming that the amount of rotation of each alignment member 51A and 51B upon contact of the alignment member 51A with the first point A1 is 0, a maximum amount of rotation of the alignment member 51B in the second stage agrees with a maximum amount RA of rotation of the alignment member 51A with the play. The maximum amount RA of rotation is an amount of rotation from the state in which the protrusion 83 of the second hub 75 is in contact with the rear end 82*b* of the stepped part 82 to the state in which the protrusion 83 comes in contact with the front end 82*a*, and corresponds to the amount of the play.

In order to determine that the difference in amount of rotation between the alignment members 51A and 51B is equal to or larger than the given value RT (amount of rotation for recognition that the height difference D reaches the allowable limit), the alignment member 51B should be capable of rotating at least the given value RT in the second stage. Accordingly, the maximum amount RA of rotation is set to be equal to or larger than the given value RT. It is noted that the maximum amount RA of rotation is defined by reference to each length of the stepped part 82 and the protrusion 83 in the circumferential direction.

As described above, the height of the distal edge C of the sheet sheaves S is kept constant, which means that an amount R1 of rotation of the alignment member 51A, an amount R1 of rotation of the alignment member 51B, and an amount R1 rotation of each lower pulley 76 are substantially constant in the first stage. In the second stage, the alignment member 51B and the pair of lower pulleys 76 are rotatable by a maximum amount (R1+RA) of rotation from the standby position P4.

Herein, each lower pulley 76 is controlled so as to rotate by an amount RP of rotation from the standby position P4 and then stop. In the present embodiment, the amount RP of rotation of each lower pulley 76 is set equal to or larger than an amount (R1+RT) of rotation and equal to or smaller than the amount (R1+RA) of rotation.

In one example, when the alignment member 51B comes in contact with the second point A2 (where the height difference D is within an allowable range) before the difference in amount of rotation of the alignment members 51A and 51B reaches the given value RT, rotation of the alignment member 51B toward the main exit tray 33 is restricted. While, each lower pulley 76 rotates up to the amount RP of rotation in the presence of the play relative to the protrusion 83 in the stepped part 82. After rotation by the amount RP of rotation, the pair of lower pulleys 76 rotate in the reverse direction by the amount RP of rotation. Then, the pair of alignment members 51A and 51B are returned to the standby state.

With reference to FIGS. 3, 4, and 11, description will be made next about detection of difference in amount of rotation between the rear and front alignment members 51A and 51B by the detection mechanism 58. The detection mechanism 58 detects the difference in amount of rotation as the height difference D between the contact parts of the alignment members 51A and 51B on the topmost surface U of sheet sheaves S. In other words, the detection mechanism 58 detects the difference in amount of rotation as the height difference D between the first and second points A1 and A2.

Where the alignment members 51A and 51B are positioned at the home positions P1, the pair of to-be-detected members 85 are in the standing-up posture in the vertical direction (see FIG. 3). At that time, the cut-out parts of the pair of to-be-detected members 85 agree with each other when viewed from front (when viewed in the shifting direction) so that the pair of to-be-detected members 85 do not intercept the light path between the light emitting element 84*a* and the light receiving element 84*b*. Accordingly, the light receiving element 84*b* receives the light from the light emitting element 84*a*.

By contrast, as shown in FIGS. 4 and 11, a difference in amount of rotation between the rear and front alignment members 51A and 51B is caused according to the height difference D. When this difference in amount of rotation reaches equal to or larger than the given value RT, the front to-be-detected member 85 intercepts the light path. Accordingly, the light receiving element 84*b*, which cannot receive the light from the light emitting element 84*a*, detects the fact that the light path is intercepted. In other words, the light receiving element 84*b* detects interception of the light path of the light that the light emitting element 84*a* emits. As described so far, the given value RT is an amount of rotation for recognition that the height difference D reaches the allowable limit. In other words, detection of interception of the light path means that the height difference D reaches the allowable limit. It is noted that the given value RT (preset value) can be obtained on an experimental or empirical basis and is stored in advance in the storage section 41*b* of the controller 41. In this manner, the height difference D can easily be detected by the single detection mechanism 58.

When the height difference D reaches the allowable limit, an operation for preventing collapse of a plurality of stacked sheet sheaves S is performed in the sheet processing device 3 according to the present embodiment. With reference mainly to FIG. 12, description will be made below about the operation for preventing collapse of sheet sheaves S.

First, when the detection result of the detection mechanism 58 is the given value RT (preset value), the detection mechanism 58 (the photointerrupter 84) outputs a detection signal indicative of interception of the light path to the control section 41*a* of the controller 41. Upon receipt of the detection signal, the controller 41 drives and controls the rotation drive section 79 to rotate the alignment members 51A and 51B from the detection positions P5 to the standby positions P4 (see the dashed and double dotted lines in FIG. 10).

Subsequently, the controller 41 drives and controls the shifting drive section 73 and the rotation drive section 79 to rotate and move the alignment members 51A and 51B from the standby positions P4 to the escape positions P2 (see FIG. 10). Further, the controller 41 drives and controls the shifting drive section 73 to move the alignment members 51A and 51B from the escape positions P2 to receiving positions P6 (see FIG. 12). The receiving position P6 of the alignment member 51A is a position where the alignment member 51A is displaced in the shifting direction from the reference position P3 to separate from the sheet sheaves S. The receiving position P6 of the alignment member 51B is a position where the alignment member 51B is displaced in the shifting direction from the reference position P3 to separate from the sheet sheaves S.

In other words, the alignment member 51A is moved rearward away from the rear end parts of sheet sheaves S or sheets P, while the alignment member 51B is moved frontward away from the front end parts thereof. Each distance between the reference positions P3 and the receiving positions P6 is set in the range from 10 mm to 20 mm. In the present embodiment, for example, the alignment member 51A is maintained in a state in which it is moved to the receiving position P6 which is 10 mm apart rearward from the reference position P3. Also, the alignment member 51B is maintained in a state in which it is moved to the receiving position P6 which is 10 mm apart frontward from the reference position P3.

According to the sheet processing device 3 in the present embodiment, in performing stapling on the rear end parts (one end parts) of sheet sheaves S in the shifting direction, the controller 41 controls the moving mechanisms 54A and 54B so that at least the front (the other) alignment member 51B in the shifting direction is moved to the receiving position P6 displaced outward (frontward) in the shifting direction from the reference position P3, which is a point where the alignment member 51B comes in contact with the front end parts (the other end parts) of the sheet sheaves S. That is, in performing stapling on the rear end parts (one end parts in the shifting direction) of sheet sheaves S, the moving mechanism 54B moves the alignment member 51B arranged correspondingly to the front end parts (the other end parts in the shifting direction) of the sheet sheaves S to the receiving position P6.

By employing such a configuration, even if the staple parts T of sheet sheaves S subjected to one-point stapling are stacked to increase the inclination of the topmost surface U to the extent that the balance of the plural stacked sheet sheaves S is lost (see the arrow in FIG. 12), the alignment member 51B moved to the receiving position P6 can receive each sheet sheaf S. Thus, the plural stacked sheet sheaves S can be prevented from collapsing. Further, the alignment members 51A and 51B for alignment of sheets P or sheet sheaves S on the main exit tray 33 in the shifting direction can work also as a member for preventing collapse of sheet sheaves S. This can reduce the number of components when compared with a configuration with an additional collapse preventing member. In turn, simplification and cost reduction of the device can be achieved.

Besides, according to the sheet processing device 3 of the present embodiment, when the inclination of the topmost surface U of plural stacked sheet sheaves S increases, so that the detection result of the detection mechanism 58 is the given value RT (preset value), that is, when the height difference D between the contact part (the first point A1) of the alignment member 51A with the topmost surface U and the contact part (the second point A2) of the alignment member 51B with the topmost surface U reaches the preset value, at least the front (the other) alignment member 51B separates from the front end parts (the other end parts) of the sheet sheaves S. In other words, where plural sheet sheaves S are stacked on the main exit tray 33 to create a possibility of collapse of the plural sheet sheaves S, the alignment member 51B is moved to the receiving position P6. Thus, the many sheet sheaves S ejected and stacked can be prevented from collapsing.

Further, according to the sheet processing device 3 of the present embodiment, by setting the distance where the alignment member 51B (the alignment member 51A) is moved (the distance between the reference position P3 and the receiving position P6) within the preset range as a limit, much more sheet sheaves S can be stacked, while displacement of the sheet sheaves S in the shifting direction can be reduced within the preset range. Thus, the plural stacked sheet sheaves S can be prevented from losing their balance to the extent of collapse.

Moreover, according to the sheet processing device 3 of the present embodiment, when at least a sheet P is ejected, the sheet alignment mechanism 40 aligns sheets P in a manner to be in contact with and catch the opposite edges of each sheet P stacked on the main exit tray 33 from the base end side of the main exit tray 33, as shown in FIG. 9. Besides, as shown in FIG. 11, ejected sheet sheaves S subjected to stapling are stacked on the main exit tray 33. Each sheet sheaf S can be obtained by performing stapling on a plurality of sheets P. When a sheet sheaf S is ejected, the sheet alignment mechanism 40 comes in contact with a plurality of points on the topmost surface U of the sheet sheaves S stacked on the main exit tray 33 and detects the height difference D between the plurality of points. In the present embodiment, the plurality of points are the first point A1 and the second point A2. According to the present embodiment, the sheet alignment mechanism 40 to align sheets P detects the height difference D between the plurality of points on the topmost surface U of sheet sheaves S stacked after stapling. Thus, the height difference D can be detected accurately, and an increase in the number of dedicated members for detection of the height difference D can be suppressed.

Still further, according to the sheet processing device 3 of the present embodiment, sheet sheaves S are stacked so that each staple part T is located in the vicinity of the side wall 30*a*, as shown in FIG. 2. Accordingly, when compared with a configuration in which sheet sheaves S are stacked so that each staple part T is located on the distal end side of the main exit tray 33, the length of the alignment members 51A and 51B can be reduced. This can easily ensure space for accommodating the alignment members 51A and 51B and can suppress a cost increase.

Yet further, according to the sheet processing device 3 of the present embodiment, as shown in FIG. 1, the lifting controller 45 controls lifting up and down of the main exit tray 33 so that the height of the distal edge C of a plurality of sheet sheaves S is kept constant. Thus, erroneous detection of the height deference D by the sheet alignment mechanism 40 (see FIG. 11) can be reduced. It is noted that the lifting controller 45 controls lifting up and down of the main exit tray 33 so that the height of the topmost surface of a plurality of sheets P is kept constant also in a similar manner.

<First Variation>

Figure 13:
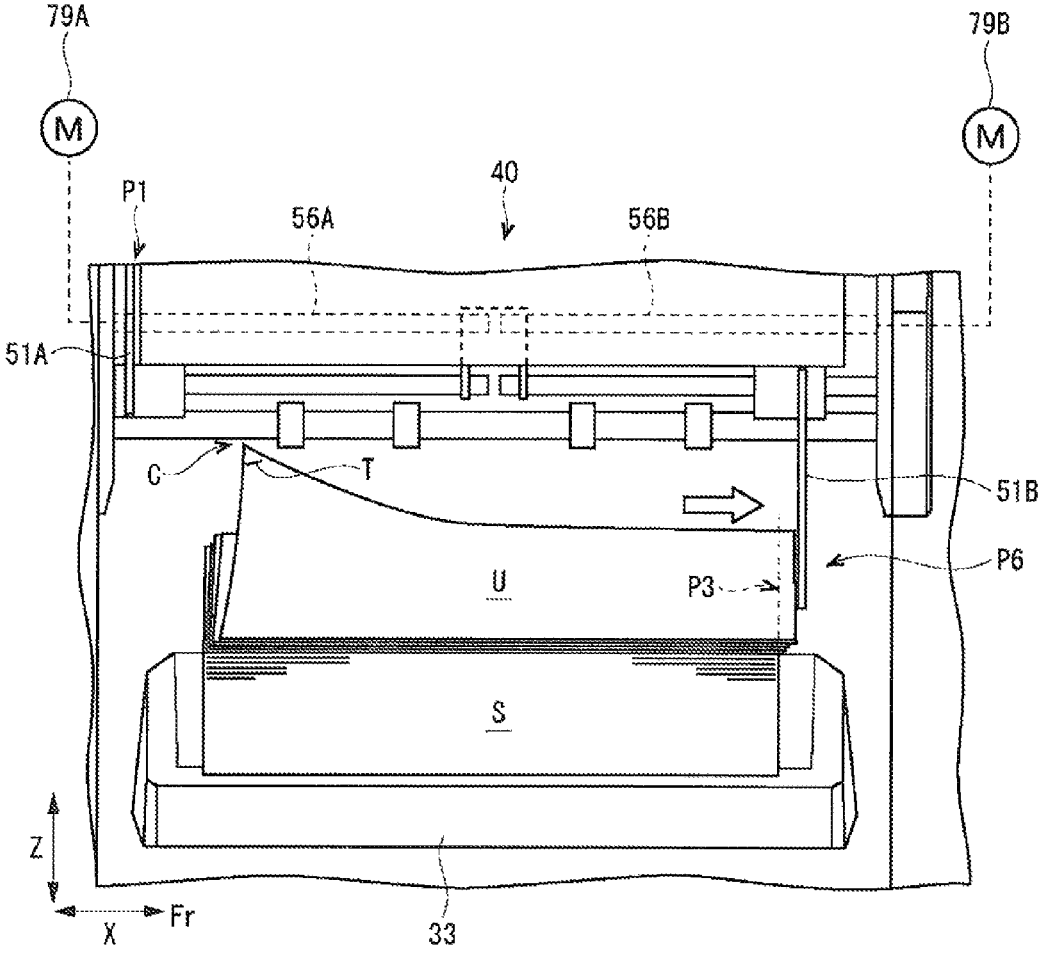
FIG. 13 is a side view for explaining an operation for preventing collapse of sheet sheaves in the sheet alignment mechanism of the sheet processing device according to the first variation of one embodiment of the present disclosure.

With reference to FIG. 13, description will be made next about a sheet processing device 3 (sheet alignment mechanism 40) according to the first variation of the present embodiment. FIG. 13 is a side view for explaining an operation for preventing collapse of sheet sheaves S in the first variation. It is noted that the same reference numerals are assigned to the same elements as in the above embodiment, and description thereof is omitted.

The alignment members 51A and 51B move to the respective receiving positions P6 in the operation for preventing collapse of sheet sheaves S in the above embodiment, which does not limit the present disclosure. Only the alignment member 51B, which is located on the opposite side to the staple parts T of sheet sheaves S, is moved to the receiving position P6 in the sheet alignment mechanism 40 according to the first variation (see FIG. 13). In other words, the controller 41 moves the alignment member 51B, which is located ahead in the direction of collapse of stacked sheet sheaves S, to the receiving position P6. To do so, a pair of rotary shafts 56A and 56B are provided adjacently so as to be spaced apart from each other in the shifting direction, similarly to the rotary shafts 55A and 55B. Additionally, rotation drive sections 79A and 79B are provided to independently drive and rotate the rotary shafts 56A and 56B, respectively.

Description will be made below about an operation for preventing collapse of sheet sheaves S in the first variation. First, similarly to the above embodiment, the controller 41 rotates the alignment members 51A and 51B from the detection positions P5 to the standby positions P4 (see the dashed and double dotted lines in FIG. 10). Subsequently, the controller 41 drives and controls the shifting drive section 73 and the rotation drive section 79A to move and rotate the alignment member 51A on the side of the raised region (the rear end side) from the standby position P4 to the home position P1 (see FIG. 13). Simultaneously, the controller 41 drives and controls the shifting drive section 73 and the rotation drive section 79B to move and rotate the alignment member 51B on the side of the flat region (the front end side) from the standby position P4 to the escape position P2 (see FIG. 10). Further, the controller 41 drives and controls the shifting drive section 73 to move the alignment member 51B to the receiving position P6 displaced outward in the shifting direction from the reference position P3 (see FIG. 13).

The sheet processing device 3 according to the first variation of the present embodiment can also prevent collapse of plural stacked sheet sheaves S in a slimier manner to the above embodiment.

<Second Variation>

Description will be made next about a sheet processing device 3 (sheet alignment mechanism 40) according to the second variation of the present embodiment. When the detection result of the detection mechanism 58 is the given value RT (preset value), the alignment member 51B is moved to the receiving position P6 in the above embodiment, which does not limit the present disclosure. In one example, the controller 41 may move the alignment member 51B to the receiving position P6 upon user's input of an instruction about one-point stapling through an operating section (not shown). Specifically, the alignment member 51B is moved to the receiving position P6 regardless of the amount of sheet sheaves S stacked on the main exit tray 33. In this case, the function of the detection mechanism 58 is suspended (does not perform height detection).

The alignment member 51B is moved to the receiving position P6 in the above embodiment including each variation (hereinafter the embodiment means the embodiment including each variation), which does not limit the present disclosure. In one example, the alignment member 51B may be moved step by step within the range from 10 mm to 20 mm from the reference position P3 according to the progress of ejection and stacking of sheet sheaves S. Further, the receiving positions P6 may be the same as the escape positions P2.

The controller 41 may move the front alignment member 51B to the receiving position P6 and suspend sheet sheaf ejection after a preset number of sheet sheaves S are ejected. Thus, the plural stacked sheet sheaves S can be prevented from collapsing further effectively.

In the case where no height detection is performed (e.g., where sheet alignment is performed), the controller 41 suspends the function of the detection mechanism 58 (photointerrupter 84). The photointerrupter 84 is of transmission type in the above embodiment, but may be of reflection type. In this case, the light receiving element detects interception of the light path upon receipt of reflected light from the to-be-detected member 85.

Furthermore, the corner on the rear end side of each sheet sheaf S is stapled with a staple (staple part T) in the above embodiment. Instead, the corner on the front end side of each sheet sheaf S may be stapled with a staple (staple part T). In this case, the controller 41 moves at least the alignment member 51A to the receiving position P6. The alignment member 51B may be controlled and moved to the home position P1 or the receiving position P6. In other words, the controller 41 may only move at least an alignment member of the alignment members 51A and 51B, which is located on the opposite side to the staple part T, to the corresponding receiving position P6.

<Third Variation>

Description will be made next about a sheet processing device 3 (the sheet alignment mechanism 40) according to the third variation of the present embodiment. When the detection result of the detection mechanism 58 is the given value RT (preset value), the alignment members 51A and 51B are moved to the receiving positions P6 in the above embodiment. However, rather than or in addition to this control, the following control may be executed.

That is, as shown in FIG. 8, the control section 41*a* controls and suspends sheet sheaf ejection to the main exit tray 33 according to the height difference D. The specific process is as follows. The control section 41*a* drives and controls the roller drive section 86 (stepping motor or the like) to rotate the plurality of main ejection section roller pairs 43, thereby ejecting a sheet P or a sheet sheaf S to the main exit tray 33. Then, upon input of a detection signal indicative of interception of the light path from the detection mechanism 58, the control section 41*a* controls the roller drive section 86 to suspend rotation of the plural main ejection section roller pairs 43. This suspends sheet sheaf ejection.

Detection of interception of the light path by the detection mechanism 58 means that the height difference D (see FIG. 11) reaches the allowable limit. Accordingly, suspension of sheet sheaf ejection in response to the detection signal from the detection mechanism 58 can prevent collapse of sheet sheaves S stacked on the main exit tray 33.

Rather than by suspending the main ejection section roller pairs 43, sheet sheaf ejection may be suspended by another method. In one example, the control section 41*a* may suspend stapling by the stapler 38. In another example, the control section 41*a* may request the image forming apparatus main body 2 to suspend sending of or image formation on a sheet P.

Alternatively, the detection mechanism 58 may output a detection signal indicative of interception of the light path to the control section 41*a* when the height difference D (see FIG. 11) exceeds the allowable limit. In this case, the given value RT is an amount of rotation for recognition that the height difference D exceeds the allowable limit Sheet sheaf ejection is suspended when the height difference D exceeds the allowable limit, thereby preventing collapse of sheet sheaves S stacked on the main exit tray 33.

As described so far, in the sheet processing device 3 according to the third variation, the sheet alignment mechanism 40 to align sheets P detects the height difference D in the topmost surface U of sheet sheaves S stacked after stapling. As a result, an increase in the number of members dedicated for detection of the height deference D can be suppressed. Further, sheet sheaf ejection to the main exit tray 33 is suspended according to the height difference D to enable prevention of collapse of sheet sheaves S stacked on the main exit tray 33.

It is noted that the above embodiments of the present disclosure describes preferable modes of the image forming apparatus 1 including the sheet processing device 3 according to the present disclosure, to which any preferable technical limitations may be added. However, the technical scope of the present disclosure is not limited to these modes unless otherwise specified in the present description. The following variations (1)-(3) are possible, for example. Further, each element in the above embodiment of the present disclosure may be replaced by any existing elements appropriately. Yet further, any variation including combination with any other existing element is possible. Thus, the above described embodiment of the present embodiment does not limit the content of the disclosure recited in the scope of claims.

(1) As described with reference to FIG. 2, each sheet sheaf S is ejected to the main exit tray 33 so that the staple part T is located closer to the alignment member 51A than to the alignment member 51B. Alternatively, each sheet sheaf S may be ejected to the exit tray 33 so that the staple part T is located closer to the alignment member 51B than to the alignment member 51A.

(2) The form of the alignment members 51A and 51B is not limited to that shown in FIG. 2. Only required for the alignment members 51A and 51B is to have a flat surface for sheet alignment and a portion for detection of the height difference D.

(3) The image forming apparatus main body 2 is, for example, a multifunction peripheral having functions of a copier, a printer, and/or a facsimile machine, a copier, a printer, or a facsimile machine.

What is claimed is:

1. A sheet processing device, comprising:

an exit tray on which ejected sheets or ejected sheet sheaves subjected to stapling are stacked;

a sheet alignment mechanism configured to align, when at least a sheet is ejected, the sheets in a manner to be in contact with and catch opposite edges of the sheets stacked on the exit tray from a base end side of the exit tray;

a lifting controller configured to lift up and down the exit tray so that a height of a corner of a topmost surface of the sheet sheaves, the corner being raised by staple parts formed in the stapling, is kept constant; and a control section, wherein when stapling is performed and a sheet sheaf is ejected, the sheet alignment mechanism comes in contact with a first point and a second point on a topmost surface of the sheet sheaves stacked on the exit tray to detect a height difference between the first and second points, the first point is located in a raised region of the topmost surface of the sheet sheaves, the raised region being raised by accumulation of the staple parts, the second point is located in a flat region of the topmost surface of the sheet sheaves, the sheet alignment mechanism includes a pair of alignment members and a detection mechanism one of the pair of alignment members comes in contact with the first point, the other of the pair of alignment members comes in contact with the second point, the one and the other of the pair of alignment members are each independently rotatable about an axial line in a shifting direction orthogonal to an ejection direction in which a sheet is ejected and to a stacking direction in which a sheet is stacked, and each have play to make difference in amount of rotation between the one and the other of the pair of alignment members when driven at the same amount of rotation, the play is set such that the difference in amount of rotation is equal to or larger than a specific amount, the specific amount indicates an amount of rotation referenced for determining that the height difference exceeds an allowable limit, the control section controls the other of the pair of alignment members to rotate until the other of the pair of alignment members is enabled to detect the specific amount in a state in which the one of the pair of alignment members is in contact with the first point, the detection mechanism detects the difference in amount of rotation between the one and the other of the pair of alignment members as the height difference between the first and second points.

2. A sheet processing device according to claim 1, wherein the sheet alignment mechanism further includes a pair of rotary shafts capable of independently rotating about the axial line, the pair of alignment members are relatively non-rotatably mounted on the pair of rotary shafts, and the detection mechanism includes:

a pair of to-be-detected members arranged between the pair of alignment members and relatively non-rotatably mounted on the pair of rotary shafts; and a sensor configured to detect a difference in amount of rotation between one and the other of the pair of to-be-detected members.

3. A sheet processing device according to claim 2, wherein the sensor includes a light emitting element and a light receiving element, and the light receiving element detects interception of a path of light, which the light emitting element emits, by one of the pair of to-be-detected members.

4. A sheet processing device according to claim 3, wherein the light emitting element and the light receiving element constitutes the sensor as a single sensor, one and the other of the pair of to-be-detected members are located opposite to each other, the one and the other of the pair of to-be-detected members each have a cut-out part, when the pair of alignment members is at a home position, the cut-out part of the one of the pair of to-be-detected members is aligned with the cut-out part of the other of the pair of to-be-detected members such as not to intercept the light path, when the difference in amount of rotation between the one and the other of the pair of alignment members is equal to or larger than the specific amount, the one of the to-be-detected members intercepts the light path, the light receiving element that constitutes the single sensor detects interception of the light path, and the control section executes control to suspend ejection of the sheet sheaf toward the exit tray in response to interception of the light path.

5. A sheet processing device according to claim 1, wherein the control section executes control to suspend sheet sheaf ejection to the exit tray according to the height difference.

6. An image forming apparatus, comprising:

a sheet processing device according to claim 1; and an image forming apparatus main body configured to form an image on the sheet.

7. A sheet processing device according to claim 1, wherein the control section execute control to cause the sheet sheaf to be ejected toward the exit tray such that a side among four sides of the sheet sheaf is located on a tail end side, the side of the sheet sheaf being closest to the staple parts among the four sides thereof, and execute control to move the one and the other of the pair of alignment members onto the first and second portions, respectively, according to a size of the sheet sheaf when the sheet sheaf subjected to one-point stapling is ejected.

8. A sheet processing device, comprising:

an exit tray on which ejected sheets or ejected sheet sheaves subjected to stapling are stacked; and a sheet alignment mechanism configured to align at least the sheets stacked on the exit tray in a manner to move the sheets in a shifting direction orthogonal to an ejection direction in which a sheet is ejected and to a stacking direction in which a sheet is stacked, wherein the sheet alignment mechanism includes:

a pair of alignment members capable of coming in contact with opposite end parts of at least the sheets in the shifting direction; and a pair of moving mechanisms configured to move the pair of alignment members in the shifting direction, when the stapling is performed on one end parts of sheet sheaves in the shifting direction, one of the pair of moving mechanisms moves an alignment member of the pair of alignment members, which is arranged correspondingly to the other end parts of the sheet sheaves in the shifting direction, to a receiving position, the receiving position is a position displaced in the shifting direction from a reference position to separate the alignment member from the sheet sheaves, the reference position is a position where the alignment member comes in contact with the other end parts of the sheet sheaves, the sheet alignment mechanism includes:

a pair of rotation mechanisms; and a detection mechanism configured to detect a difference in amount of rotation between one and the other of the pair of alignment members as a height difference between first and second points on a topmost surface of the sheet sheaves, the first point is closer to the one end parts of the sheet sheaves than the second point, the second point is closer to the other end parts of the sheet sheaves than the first point, one of the pair of rotation mechanisms rotates one of the pair of alignment members, which is arranged correspondingly to the one end parts of the sheet sheaves, in the stacking direction about a rotary shaft extending in the shifting direction above the exit tray so that the one of the pair of alignment members comes in contact with the first point, the other of the pair of rotation mechanisms rotates the other of the pair of alignment members, which is arranged correspondingly to the other end parts of the sheet sheaves, in the stacking direction about the rotary shaft so that the other of the pair of alignment members comes in contact with the second point, and when a detection result of the detection mechanism is a preset value, one of the pair of moving mechanisms moves the alignment member arranged correspondingly to the other end parts of the sheet sheaves to the receiving position.

9. A sheet processing device according to claim 8, further comprising:

an ejection mechanism configured to send out a sheet or a sheet sheaf to the exit tray; and a lifting controller configured to lift up and down the exit tray so that a height of a corner of a topmost surface of the sheet sheaves, which is a corner raised by staple parts formed in the stapling, is kept constant relative to at least one of a floor surface, the rotary shaft, and the ejection mechanism as a reference.

10. A sheet processing device according to claim 8, wherein a distance between the reference position and the receiving position is in a range from 10 mm to 20 mm.

11. An image forming apparatus, comprising:

a sheet processing device according to claim 8; and an image forming apparatus main body configured to form an image on the sheet.

12. A sheet processing device, comprising:

an exit tray on which ejected sheets or ejected sheet sheaves subjected to stapling are stacked; and a sheet alignment mechanism configured to align at least the sheets stacked on the exit tray in a manner to move the sheets in a shifting direction orthogonal to an ejection direction in which a sheet is ejected and to a stacking direction in which a sheet is stacked, wherein the sheet alignment mechanism includes:

a pair of alignment members capable of coming in contact with opposite end parts of at least the sheets in the shifting direction; and a pair of moving mechanisms configured to move the pair of alignment members in the shifting direction, when the stapling is performed on one end parts of sheet sheaves in the shifting direction, one of the pair of moving mechanisms moves an alignment member of the pair of alignment members, which is arranged correspondingly to the other end parts of the sheet sheaves in the shifting direction, to a receiving position, the receiving position is a position displaced in the shifting direction from a reference position to separate the alignment member from the sheet sheaves, the reference position is a position where the alignment member comes in contact with the other end parts of the sheet sheaves, and a distance between the reference position and the receiving position is in a range from 10 mm to 20 mm.

13. An image forming apparatus comprising:

a sheet processing device according to claim 12; and an image forming apparatus main body configured to form an image on the sheet.

* * * * *